United States Patent [19]

Kaneko

[11] Patent Number: 4,880,733

[45] Date of Patent: Nov. 14, 1989

[54] LIGHT-SENSITIVE SILVER HALIDE PHOTOGRAPHIC MATERIAL

[75] Inventor: Yutaka Kaneko, Hino, Japan

[73] Assignee: Konica Corporation, Tokyo, Japan

[21] Appl. No.: 138,711

[22] Filed: Dec. 24, 1987

[30] Foreign Application Priority Data

| | | | |
|---|---|---|---|
| Dec. 25, 1986 | [JP] | Japan | 61-315772 |
| Dec. 26, 1986 | [JP] | Japan | 61-314575 |
| Dec. 26, 1986 | [JP] | Japan | 61-314576 |
| Dec. 26, 1986 | [JP] | Japan | 61-314577 |
| Dec. 27, 1986 | [JP] | Japan | 61-314141 |

[51] Int. Cl.[4] ..... G03C 7/38

[52] U.S. Cl. ..... 430/551; 430/558

[58] Field of Search ..... 430/551, 558 R, 372

[56] References Cited

U.S. PATENT DOCUMENTS

| | | | |
|---|---|---|---|
| 4,268,621 | 5/1981 | Ogi et al. | 430/551 |
| 4,623,617 | 11/1986 | Kaneko et al. | 430/551 |
| 4,639,415 | 1/1987 | Kaneko et al. | 430/551 |

FOREIGN PATENT DOCUMENTS

| | | | |
|---|---|---|---|
| 202770 | 11/1986 | European Pat. Off. . | |
| 0244160 | 11/1987 | European Pat. Off. | 430/551 |
| 61-184543 | 2/1985 | Japan . | |
| 61-241753 | 4/1985 | Japan . | |
| 1273544 | 12/1986 | Japan | 430/372 |

*Primary Examiner*—Richard L. Schilling

*Attorney, Agent, or Firm*—Jordan B. Bierman

[57] ABSTRACT

A silver halide photographic light-sensitive material having improved stability in the dye image against light and moisture and comprising a magenta dye-forming coupler represented by formula [M-I], a compound represented by formula [A] shown below is disclosed. This technical advantage is enhanced by the use of a compound represented by formula [$B_1$], [$B_2$] or [$B_3$] as defined in the description.

[M-I]

wherein Z represents a group of non-metal atoms necessary to complete a nitrogen-containing heterocycle which may have a substituent, X represents a hydrogen atom or a group capable of being split-off upon reaction with the oxidation product of a color developing agent and R represents a hydrogen atom or a substituent;

[A]

wherein $R^1$ represents an aryl group or heterocyclic group, $Z_1$ and $Z_2$ independently represent an alkylene group having 1 to 3 carbon atoms provided that the total number of carbon atoms, within the alkylene groups represented by $Z_1$ and $Z_2$ is 3 to 6, and n is 1 or 2.

5 Claims, No Drawings

LIGHT-SENSITIVE SILVER HALIDE PHOTOGRAPHIC MATERIAL

FIELD OF THE INVENTION

The present invention relates to a silver halide photographic light-sensitive material for forming a dye image which is stable to heat and light, and free from the occurrence of stain.

BACKGROUND OF THE INVENTION

It is desirable for a dye image available from a silver halide photographic light-sensitive material not to discolor or fade even if exposed to light for a prolonged period or even when stored under the conditions of a high temperature and high humidity. Also it is desirable for a non-dye-image portion of a silver halide photographic light-sensitive material not to turn yellow (hereinafter termed "Y-stain") due to light or moisture/heat.

As a coupler for forming a magenta dye image, pyrazolone couplers, pyrazolobenzimidazole couplers, pyrazolotriazole couplers and indazolone couplers are known in the art.

However, when compared to a yellow coupler or a cyan coupler, the Y-stain in a non-dye-image portion due to moisture/heat as well as the fading in a dye-image portion due to light occur more often and in significantly larger scales, thus frequently posing a disadvantage.

The couplers widely used for forming a magenta dye are 1,2-pyrazolo-one couplers. A dye formed from a 1,2-pyrazolo-5-one magenta coupler disadvantageously has a secondary absorption in a range around 430 nm, in addition to a primary absorption in a range around 550 nm, and thus causing a great disadvantage. To solve this disadvantage, various researches have been conducted.

For instance, the magenta couplers, having an anilino group in the 3-position of 1,2-pyrazolo-5-one and disclosed for example in U.S. Pat. No. 2,343,704 and British Pat. No. 1,059,994, has a smaller secondary absorption and is accordingly useful in forming a color image for a color print.

The above-mentioned magenta couplers, however, has disadvantages. A formed image has a poor image presorvativity, and, especially, the fastness of a dye image to light is extremely poor. Also, the Y-stain in a non-dye-image portion occurs in a larger scale.

As other means to limit the secondary absorption of the above magenta couplers in a range around 430 nm, the following magenta couplers were proposed: pyrazolobenzimidazoles described in British Pat. No. 1,047,612; indazolones described in U.S. Pat. No. 3,770,447; 1H-pyrazolo[5,1-c]-1,2,4-triazole couplers described in U.S. Pat. No. 3,725,067, British Pat. Nos. 1,252,418 1,334,515; 1H-pyrazolo[1,5-b]-1,2,4-triazole couplers described in Japanese Patent Publication Open to Public Inspection (hereinafter referred to as Japanese Patent O.P.I. Publication) No. 171956/1974, and Research Disclosure No. 24,531; 1H-pyrazolo[1,5-c]-1,2,3-triazole couplers described in Research Disclosure No. 24,626; 1H-imidazo[1,2-b]-pyrazole couplers described in Japanese Patent Publication Open to Public Inspection No. 162548/1974, and Research Disclosure No. 24,531; 1H-pyrazolo[1,5-b]pyrazole couplers described in Japanese Patent O.P.I. Publication No. 43659/1985, and Research Disclosure No. 24,230; 1H-pyrazolo[1,5-d]tetrazole couplers described in Japanese Patent Publication Open to Public Inspection No. 33552/1975, and Research Disclosure No. 24,220; and others. Dyes formed especially from 1H-pyrazolo[5,1-c]-1,2,4-triazole couplers, 1H-pyrazolo[1,5-b]-1,2,4-triazole couplers, 1H-pyrazolo[1,5-c]-1,2,3-triazole couplers, 1H-imidazo[1,2-b]pyrazole couplers, 1H-pyrazolo[1,5-d]pyrazole couplers and 1H-pyrazolo[1,5-d]tetrazole couplers are significantly advantageous; these dyes, when compared to the previously mentioned dyes formed from 1,2-pyrazolo-5-ones which have in the 3-position an anilino group, have a significantly limited secondary absorption in a range around 430 nm, and are favorable in terms of color reproduction, and, additionally, the non-dye-image portion is least prone to subject to the Y-stain due to light, heat, or moisture.

However, azomethine dyes formed from these couplers are extremely vulnerable to light, and, worse, these dyes readily discolor due to light. Such disadvantage significantly limits the performance of a silver halide color photographic light-sensitive material especially for print. Accordingly, these couplers are not commercially used for a silver halide color photographic light-sensitive material for print.

Japanese Patent O.P.I. Publication No. 125732/1984 disclosed a proposed technique for improving light-fastness of a magenta dye image available from a 1H-pyrazolo[5,1-c]-1,2,4-triazole class magenta coupler, by using in addition to this type of coupler a phenol compound or a phenyl ether compound. This technique, however, is unsatisfactory in eliminating the fading of the magenta dye image due to light, and, it was learned that preventing light-induced discoloration is virtually impossible with this technique.

OBJECT OF THE INVENTION

The first object of the present invention is to provide a silver halide photographic light-sensitive material with which a formed magenta dye does not have a secondary absorption range, and, accordingly, the fastness of the magenta dye image to light is significantly improved.

The second object of the invention is to provide a silver halide photographic light-sensitive material being capable of forming a magenta dye image which is least prone to discolor due to light.

The third object of the invention is to provide a silver halide photographic light-sensitive material with which the Y-stain in the non-dye-image portion due to light, and moisture/heat is eliminated.

The above objects of the invention is attained by a silver halide photographic light-sensitive material which contains at least one magenta coupler selected from those represented by the following general formula [M-1], as well as at least one compound selected from those represented by the following general formula [A]:

General formula [M-1]

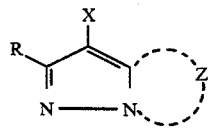

In this formula, Z represents a plurality of non-metal atoms necessary for forming a nitrogen-containing heterocycle, and the heterocycle formed by Z may have a substituent.

X represents a hydrogen atom, or a group capable of being split off upon reaction with the oxidation product of a color developing agent.

R represents a hydrogen atom, or a substituent;

General formula [A]

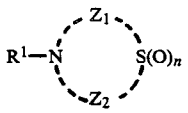

In this formula, $R^1$ represents an aryl group or heterocyclic group; $Z_1$ and $Z_2$ independently represent an alkylene group having 1 to 3 carbon atoms; provided that the total of carbon atoms within the alkylene groups represented by $Z_1$ and $Z_2$ ranges from 3 to 6; and n represents 1 or 2.

PREFERABLE EMBODIMENTS OF THE INVENTION

According to one of the preferable embodiments of the present invention, the above objects of the present invention are advantageously attained by a silver halide photographic light-sensitive material containing at least one magenta dye image forming coupler selected from those represented by the general formula [M-I], at least one compound selected from those represented by the general formula [A], and at least one compound selected from those represented by the following general formula [$B_1$]:

General formula [$B_1$]

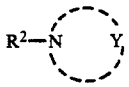

In this formula, $R^2$ represents an aliphatic group, a cycloalkyl group, an aryl group or a heterocyclic group, and Y represents a plurality of non-metal atoms necessary for forming a piperazine ring or homopiperazine ring together with a nitrogen atom.

According another preferable embodiment of the present invention, the above objects of the present invention are advantageously attained by a silver halide photographic light-sensitive material having at least one magenta dye-image forming coupler expressed by the General Formula [M-1], at least one compound expressed by the General Formula [A] and at least one compound selected from a group of compounds expressed by the following General Formula [$B_2$]:

General Formula [$B_2$]

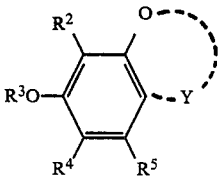

In the above formula, $R^2$ and $R^5$ respectively represent a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group or an alkoxycarbonyl group. $R^3$ represents a hydrogen atom, an alkyl group, an alkenyl group, an aryl group, an acyl group, a cycloalkyl group or a heterocyclic group. $R^4$ represents a hydrogen atom, a halogen atom, an alkyl group, an alkenyl group, an aryl group, an aryloxy group, an acyl group, an acylamino group, an acyloxy group, a sulfonamide group, a cycloalkyl group or an alkoxycarbonyl group.

$R^3$ and $R^4$ may be linked together to form a five or six-membered ring.

Also, $R^3$ and $R^4$ may be linked together to form a methylendioxy ring.

Y represents a plurality of atoms necessary for forming a chroman or coumarane ring.

According to further preferable embodiment of the present invention, the objects of the present invention are advantageously attained by a silver halide photographic light-sensitive material having at least one magenta dye-image forming coupler expressed by the General Formula [M-1], at least one compound expressed by the General Formula [A] and at least one compound selected from a group of compounds expressed by the following General Formula [$B_3$].

General Formula [$B_3$]

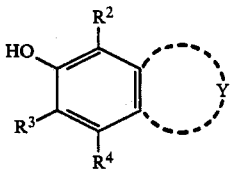

In the above formula, $R^2$ and $R^4$ respectively represent a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group or an alkoxycarbonyl group. $R^3$ represents a hydrogen atom, an alkyl group, an alkenyl group, an aryl group, an acyl group, an acylamino group, an acyloxy group, a sulfonamide group, a cycloalkyl group or a heterocyclic group.

$R^3$ and $R^4$ may be linked together to form a five or six-membered ring.

Y represents a plurality of atoms necessary for forming an indan ring.

According to still further preferable embodiment of the present invention, the objects of the present invention are advantageously attained by a silver halide photographic light-sensitive material containing at least one magenta dye image forming coupler selected from those represented by the following general formula [M-1], at least one compound selected from those represented by the following general formula [A], at least one compound selected from those represented by the following general formula [$B_1$], and at least one compound selected from those represented by the following general formulas [$B_2$] and [$B_3$].

DETAILED DESCRIPTION OF THE INVENTION

The present invention is hereinunder described in detail.

With a magenta coupler represented by the general formula [M-1] of the invention;

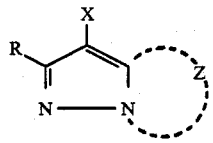

Z represents a plurality of non-metal atoms necessary for forming a nitrogen-containing heterocycle, and the heterocycle formed by Z may have a substituent.

X represents a hydrogen atom, or a group capable of being split off upon reaction with the oxidation product of a color developing agent.

R represents a hydrogen atom, or a substituent.

The scope of possible substituents which R represents is not specifically limited. However, the typical examples of such a substituent include an alkyl group, an aryl group, an anilino group, an acylamino group, a sulfonamide group, an alkylthio group, an arylthio group, an alkenyl group, and a cycloalkyl group. The examples further include a halogen atom, a cycloalkenyl group, an alkynyl group, a heterocyclic ring, a sulfonyl group, a suflinyl group, a phosphonyl group, an acyl group, a carbamoyl group, a sulfamoyl group, a cyano group, an alkoxy group, an aryloxy group, a heterocyclic oxy group, a siloxy group, an acyloxy group, a carbamoyloxy group, an amino group, an alkylamino group, an imide group, an ureide group, a sulfamoylamino group, an alkoxycarbonylamino group, an aryloxycarbonylamino group, an alkoxycarbonyl group, an aryloxycarbonyl group, a heterocyclic thio group, as well as a spiro residue, a bridged hydrocarbon residue and the like.

A preferred alkyl group represented by R is an alkyl group having 1 to 32 carbon atoms and may be either straight-chained or branched.

A preferred aryl group represented by R is a phenyl group.

A preferred acylamino group represented by R is an alkylcarbonylamino group, an arylcarbonylamino group or the like.

A preferred sulfonamide group represented by R is an alkylsulfonylamino group, an arylsulfonylamino group or the like.

A preferred alkyl component or aryl component either in an alkylthio group or aryl thio group represented by R is any of the above alkyl groups or aryl groups represented by R.

A preferred alkenyl group represented by R is an alkenyl group having 2 to 32 carbon atoms. A preferred cycloalkyl group represented by R is a cycloalkyl group having 3 to 12, especially, 5 to 7 carbon atoms. Such an alkenyl group may be either straight-chained or branched.

A preferred cycloakenyl group represented by R has 3 to 12, especially, 5 to 7 carbon atoms.

The examples of other groups represented by R are as follows:

The examples of a sulfonyl group include an alkylsulfonyl group, and an arylsulfonyl group;

The examples of a sulfinyl group include an alkylsulfinyl group, and an arylsulfinyl group;

The examples of a phosphonyl group include an alkylphosphonyl group, an alkoxyphosphonyl group, an aryloxyphosphonyl group, and an arylphosphonyl group;

The examples of an acyl group include an alkylcarbonyl group, and an arylcarbonyl group;

The examples of a carbamoyl group include an alkylcarbamoyl group, and an arylcarbamoyl group;

The examples of a sulfamoyl group include an alkylsulfamoyl group, and an arylsulfamoyl group;

The examples of an acyloxy group include an alkylcarbonyloxy group, and arylcarbonyloxy group;

The examples of carbamoyloxy group include an alkylcarbamoyloxy group, and an arylcarbamoyloxy group;

The examples of an ureide group include an alkylureide group, an arylureide group;

The examples of a sulfamoylamino group include an alkylsulfamoylamino group, and an arylsulfamoylamino group;

The heterocyclic group should preferably a five- to seven-membered group and the preferred examples include a 2-furil group, a 2-thienyl group, a 2-pyrimidinyl group, and a 2-benzothiazolyl group;

The heterocyclic oxy group should preferably be a five to seven-membered heterocyclic group and the examples include a 3,4,5,6-tetrahydropyranyl-2-oxy group, and a 1-phenyltetrazole-5-oxy group;

The heterocyclic thio group should preferably have a five to seven-membered heterocycle and the examples include a 2-pyridylthio group, a 2-benzothiazolylthio group, a 2,4-diphenoxy-di-1,3-1,3,5-triazole-6-thio group;

The examples of a siloxy group include a trimethylsiloxy group, a triethylsiloxy group, and a dimethylbutylsiloxy group;

The examples of an imide group include a succinic imide group, a 3-heptadecylsuccinic imide group, a phthalic imide group, and a glutaric imide group;

The examples of a spiro residue include a spiro[3.3-]heptane-1-yl;

The examples of a bridged hydrocarbon residue include a bicyclo[2.2.1] heptane-1-yl, a tricyclo[3.3.1.1 $^{37}$]decane-1-yl, and a 7,7[2.2.1]heptane-1-yl.

The examples of a group which is capable of split off upon reaction with the oxidation product of a color developing agent are as follows:

a halogen atom (chlorine atom, bromine atom or fluorine atom), an alkoxy group, an aryloxy group, a heterocyclic oxy group, an acyloxy group, a sulfonyloxy group, an alkoxycarbonyloxy group, an aryloxycarbonyl group, an alkyloxazolyloxy group, an alkoxyazoloxy group, an alkylthio group, a heterocyclic thio group, an alkyloxythiocarbonylthio group, an acylamino group, a sulfonamide group, a nitrogen-containing heterocycle having a bond with an N atom, an alkyloxycarbonylamino group, an aryloxycarbonylamino group, an aryloxycarbonyl amino group, a carboxyl group, and

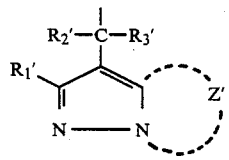

(wherein $R^{1'}$ is identical with the previously defined R; Z' is identical with the previously defined Z; $R^{2'}$ and $R^{3'}$ independently represent a hydrogen atom, an aryl group, an alkyl group or a heterocyclic group). The preferred group is a halogen atom, in particular, a chlorine atom.

The examples of a nitrogen-containing heterocycle formed by Z or Z' include a pyrazole ring, an imidazole ring, a triazole ring, and a tetrazole ring. The examples of such a heterocycle may have are identical with those previously mentioned for R.

Those represented by the general formula [M-I] are more specifically represented by any of the following general formulas [M-II] through [M-VII].

Formula [M-II]

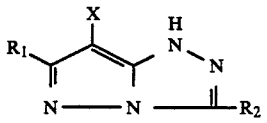

Formula [M-III]

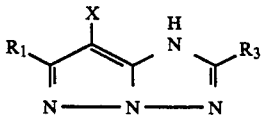

Formula [M-IV]

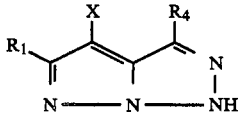

Formula [M-V]

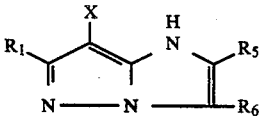

Formula [M-VI]

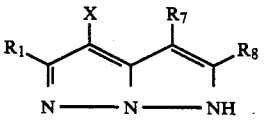

Formula [M-VII]

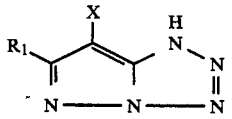

Those repreented by $R_1$ through $R_8$ as well as X in any of the above general formulas [M-II] through [M-VII] are identical with those represented by previously defined R and $X^1$. Additionally, those preferable among the compounds of the general formula [M-I] are those represented by the following general formula [M-VIII].

General formula [M-VIII]

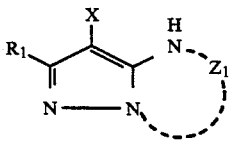

In this formula, $R_1$ and $Z_1$ are identical with R, $X^1$ and Z in the general formula [M-I].

Among the magenta couplers represented by any of the general formulas [M-II] through [M-VII], those especially preferable are the magenta couplers represented by general formula [M-II].

The most advantageous examples of a substituent R or $R_1$ on the previously mentioned heterocycle are those represented by the following general formula [M-IX].

General formula [M-IX]

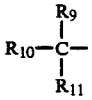

In this formula, $R_9$, $R_{10}$ and $R_{11}$ are identical with the previously defined R.

Two of the above $R_9$, $R_{10}$ and $R_{11}$, for example, $R_9$ and $R_{10}$ may bond together to form a saturated or unsaturated ring (for example, cycloalkane, cycloalkene, or heterocycle), and, additionally, $R_{11}$ may bond to the ring to form a bridged hydrocarbon residue.

The most advantageous compounds represented by general formula [M-IX] are defined as follows:

(i) At least two of $R_9$ through $R_{11}$ are alkyl groups;

(ii) One out of $R_9$ through $R_{11}$, for example, $R_{11}$ is a hydrogen atom, and other two i.e. $R_9$ and $R_{10}$ bond with each other to form a cycloalkyl group together with a root carbon atom.

The most advantageous case among (i) is that two out of $R_9$ through $R_{11}$ are alkyl groups and the other one is a hydrogen atom or an alkyl group.

Additionally, those advantageous as a substituent a ring formed by Z in general formula [M-I] or by $Z_1$ in general formula [M-VIII], or as $R_2$ through $R_8$ in general formulas [M-II] through [M-VI], are those represented by the following general formula [M-X].

General formula [M-X]

$$-R^1-SO_2-R^2$$

In this formula, $R_1$ represents an alkylene group, $R_2$ represents an alkyl group, a cycloalkyl group or an aryl group.

A preferred alkylene group represented by $R_1$ has in the straight chain portion more than 2, especially, 3 to 6 carbon atoms, and may be either straight chained or branched.

A preferred cycloalkyl group represented by $R_2$ is a five or six-membered cycloalkyl group.

The typical examples of the compounds useful in embodying the present invention are as follows.

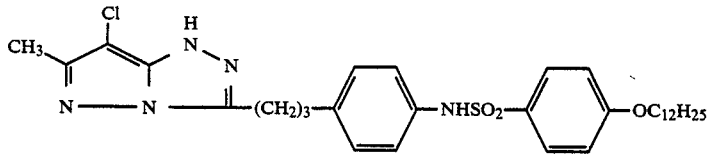

1

-continued
2
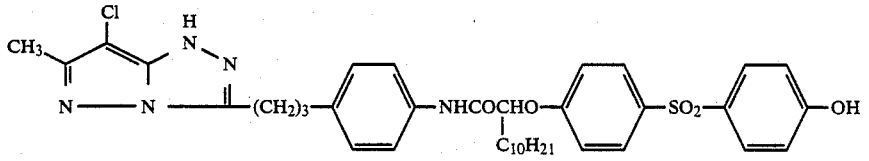
3
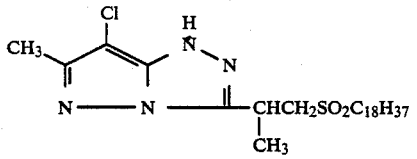
4
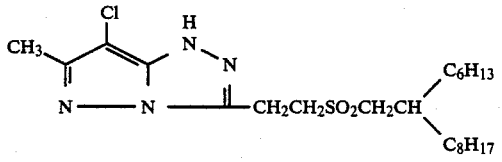
5
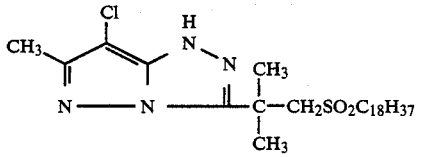
6
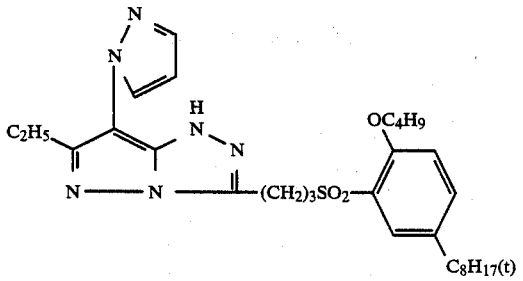
7
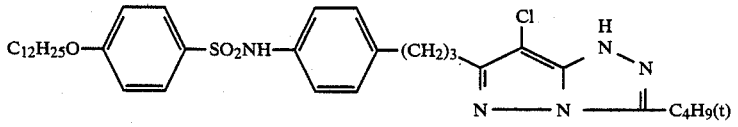
8
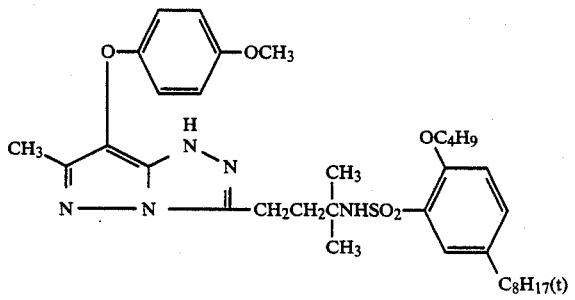
9
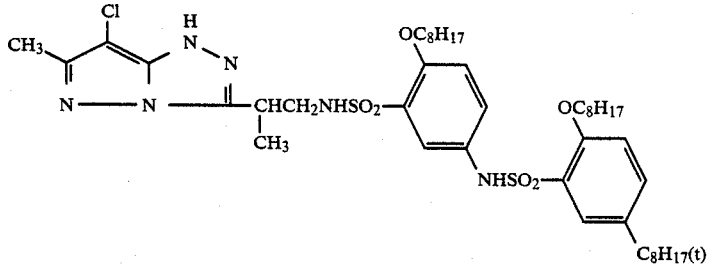

-continued
10
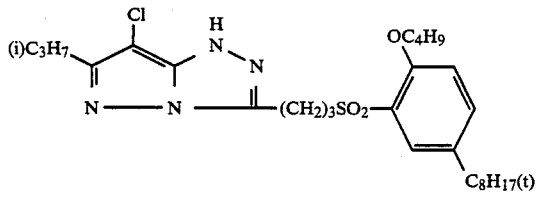
11
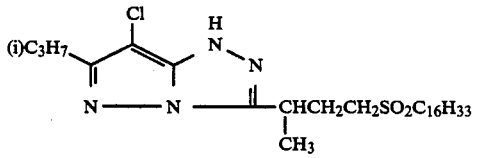
12
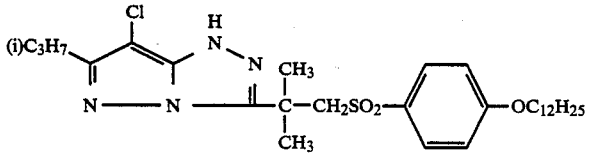
13
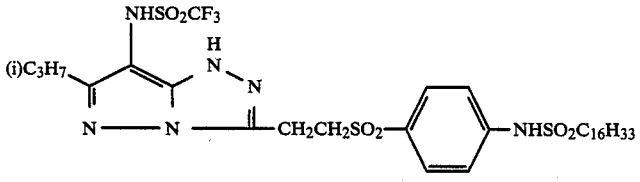
14
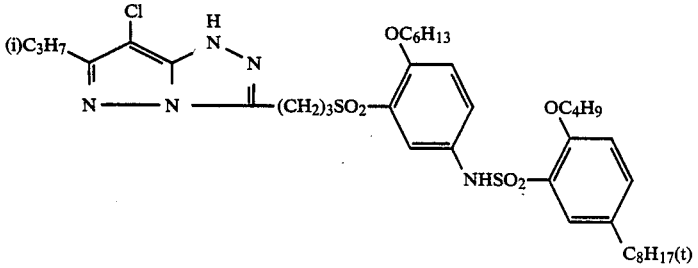
15
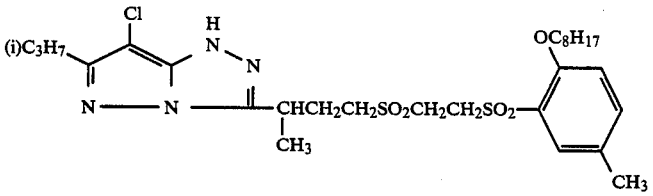
16
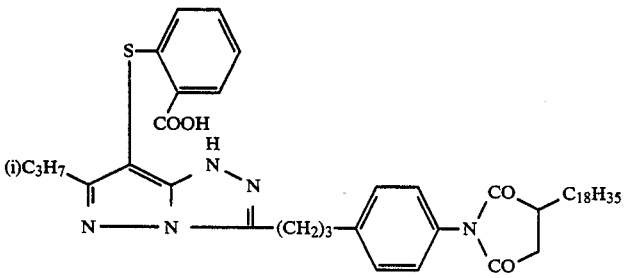
17
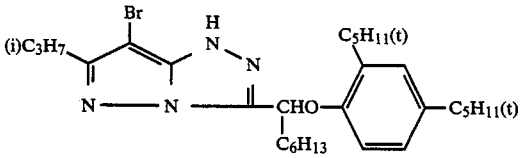

-continued
18
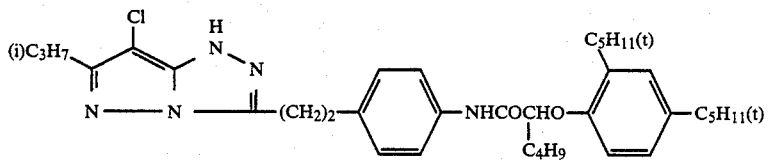
19
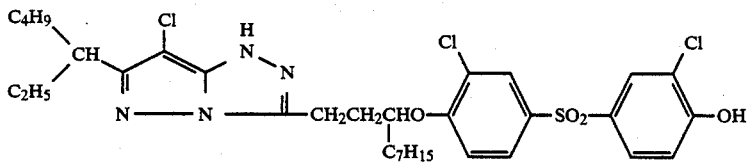
20
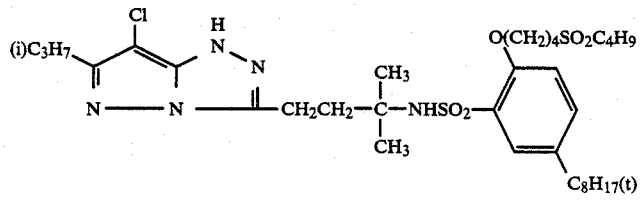
21
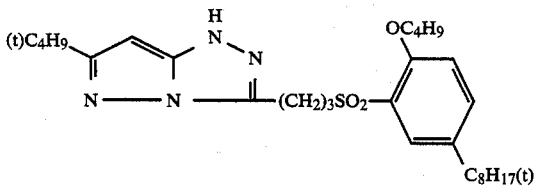
22
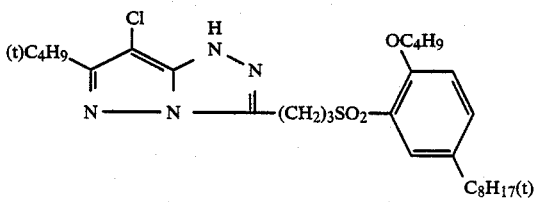
23
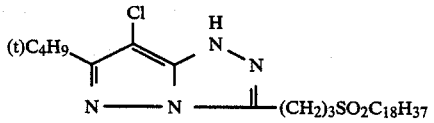
24
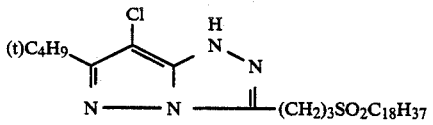
25
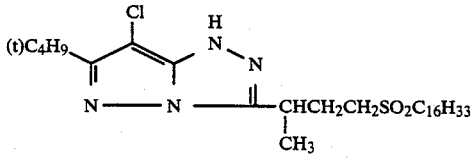
26
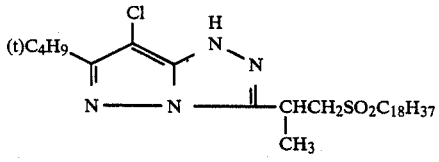

-continued
27
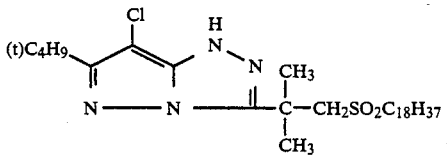
28
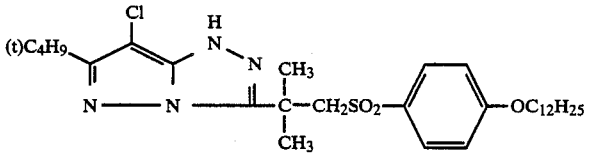
29
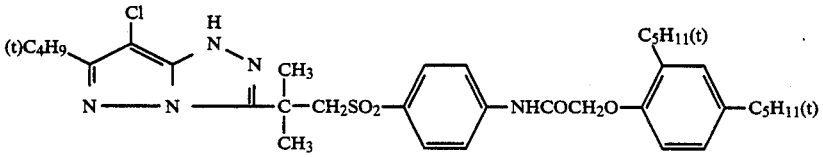
30
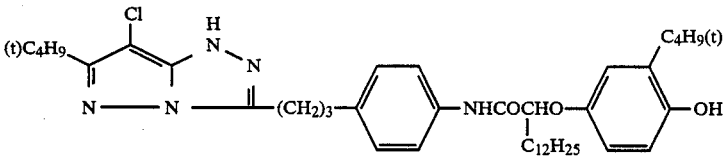
31
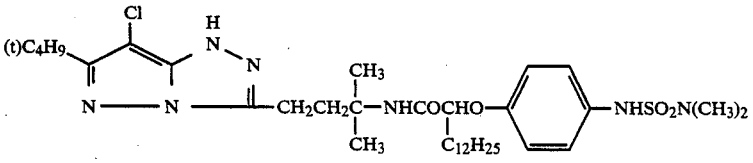
32
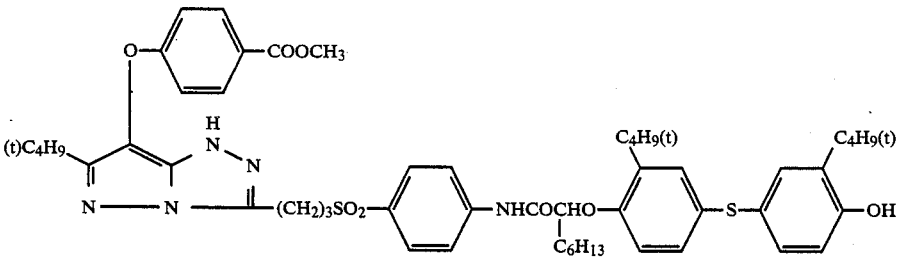
33
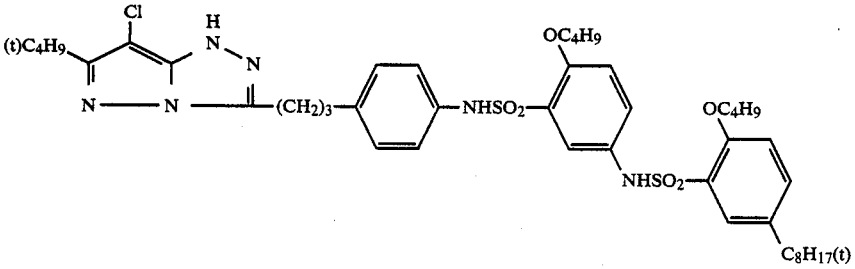
34
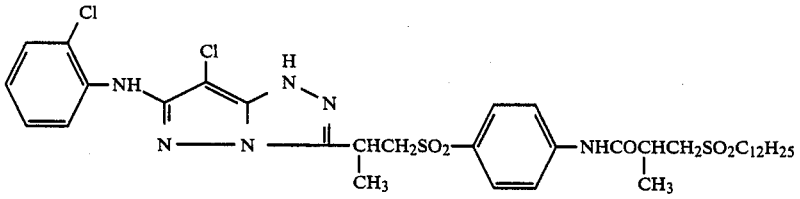

-continued
35
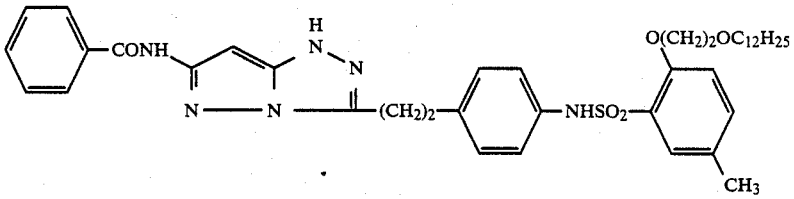
36
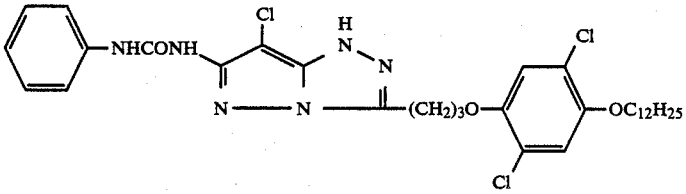
37
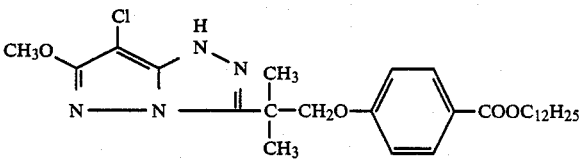
38
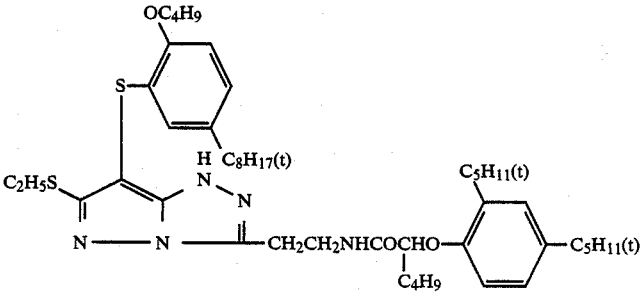
39
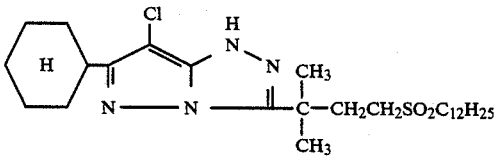
40
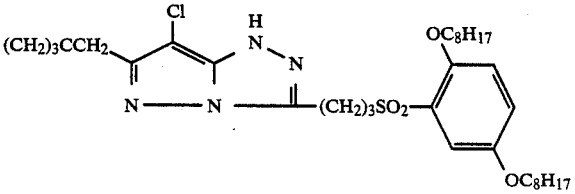
41
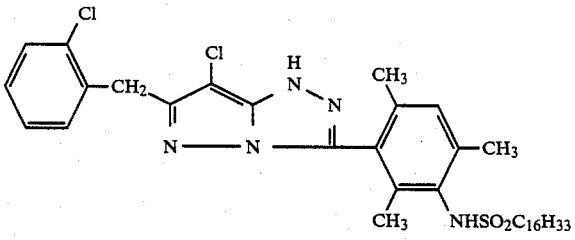

-continued
42
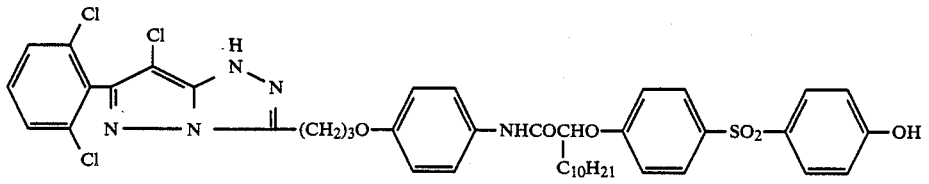
43
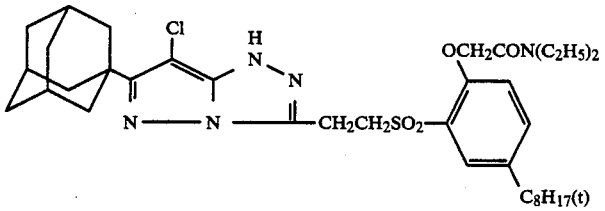
44
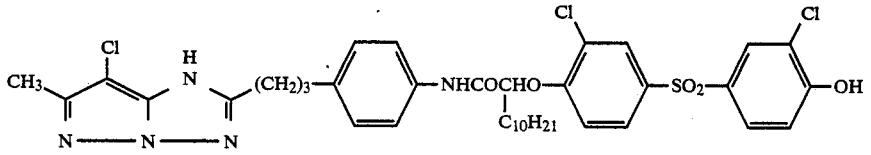
45
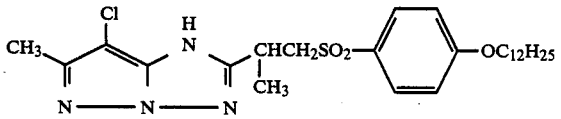
46
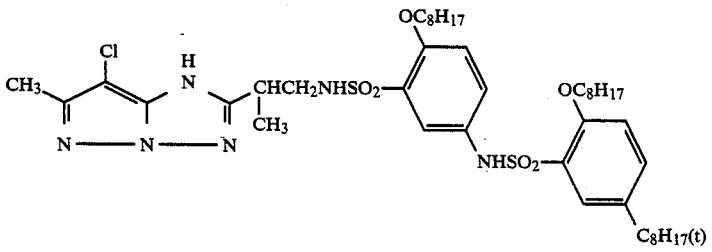
47
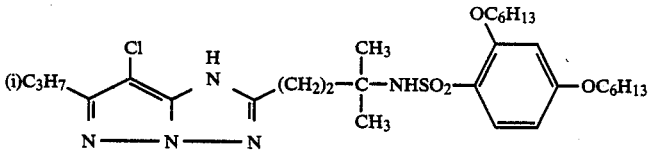
48
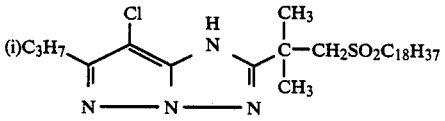
49
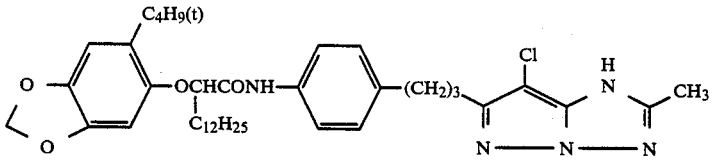

-continued
50
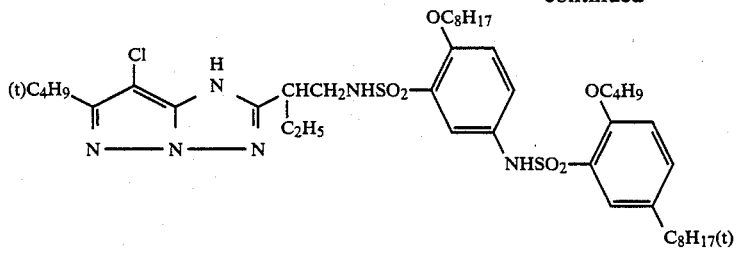
51
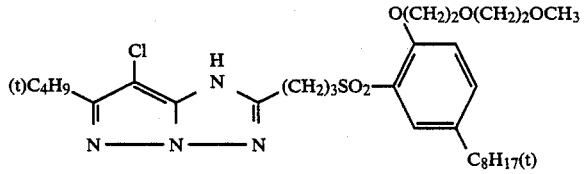
52
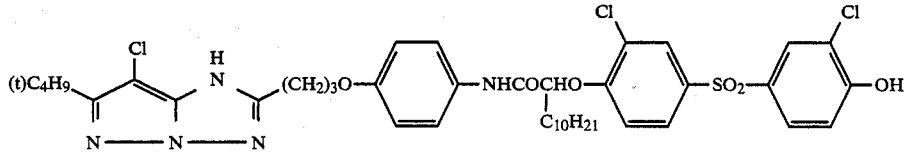
53
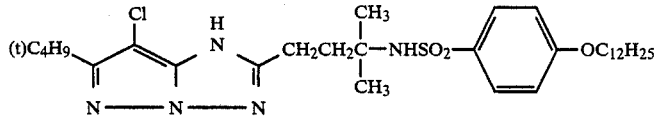
54
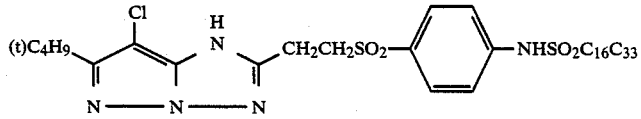
55
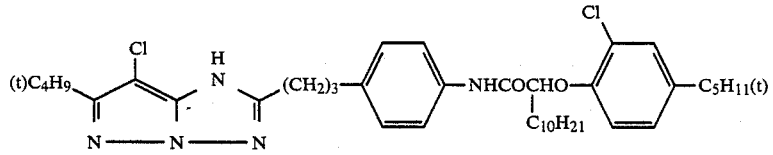
56
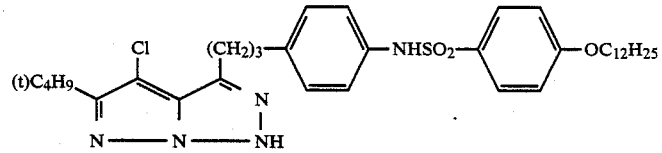
57
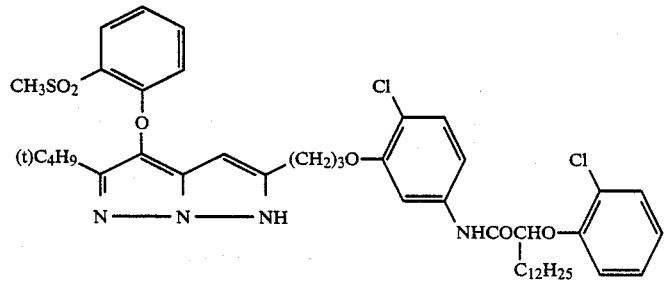
58
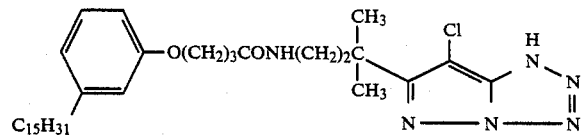

-continued

59

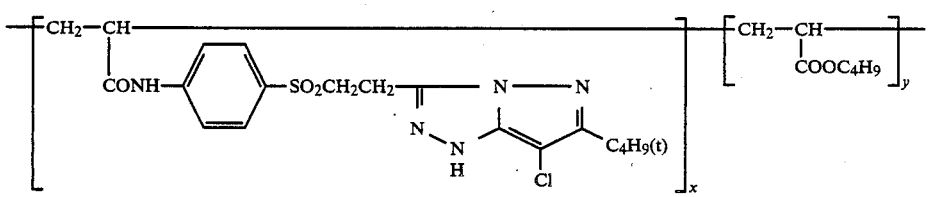

x:y = 50:50

60

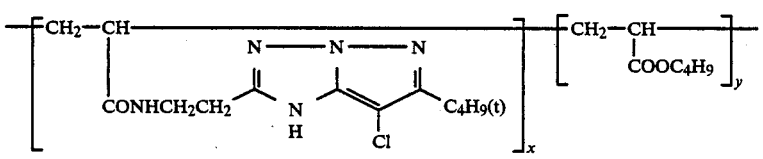

x:y = 50:50

Other than the above listed compounds, which are the typical compounds useful in embodying the present invention, other compounds also useful in embodying the invention are as follows: among the compounds described in pp. 66 through 122 in Japanese Patent Application No. 9791/1986, those compounds identified as No. 1 through 4, 6, 8 through 17, 19 through 24, 26 through 43, 45 through 59, 61 through 104, 106 through 121, 123 through 162, and 164 through 223.

Additionally, those versed in the photographic art may synthesize the magenta couplers represented by the general formula [M-I] (hereinafter called the magenta couplers of the invention) by referring to the following literatures and patents: Journal of the Chemical Society, Perkin I (1977), pp. 2047–2052; U.S. Pat. No. 3,725,067; Japanese Patent Publications Open to Public Inspection No. 99437/1974, No. 42045/1973, No. 162548/1974, No. 171956/1974, No. 33552/1985, No. 43659/1985, No. 172982/1985, No. 190779/1985 and others.

A magenta coupler of the invention may be usually added at a rate of $1\times10^{-3}$ mol to 1 mol, more favorably, $1\times10^{-2}$ mol to $8\times10^{-1}$ mol per mol silver halide.

A magenta coupler of the invention may be used together with another type of magenta coupler.

When used together with a magenta coupler of the invention, a compound represented by the general formula [A] (a magenta dye image stabilizer of the invention), which is contained in the silver halide photographic light-sensitive material of the invention, is capable of preventing not only fading of a magenta dye image due to light but discoloration due to light.

An aryl group represented by $R^1$ in the general formula [A] is for example a phenyl group, a 1-naphtyl group or the like. Such an aryl group may have a substituent. The examples of such a substituent include those typified as the substituent that R in the general formula [M-I].

A heterocyclic group represented by $R^1$ in the general formula [A] is for example a 2-furil group, a 2-thienyl group or the like. Such a heterocyclic group may have a substituent for example such as any of the example substituents for R in the general formula [M-I].

$Z_1$ and $Z_2$ independently represent an alkylene having 1 to 3 carbon atoms. The total of carbon atoms in the alkylenes represented by $Z_1$ and $Z_2$ ranges from 3 to 6. These alkylene groups may independently have any of the substituents which R in the general formula [M-I] may have.

n represents 1 or 2.

According to the invention, an especially advantageous compound, represent by the general formula [A], has a phenyl group as $R^1$, ethylene groups as $Z_1$ and $Z_2$, and n is 2.

The typical examples of a magenta dye image stabilizer according to the invention are listed below.

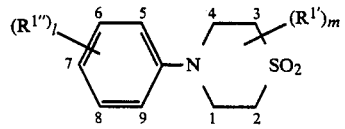

| Compound | $R^{1'}$ | m | $R^{1''}$ | l |
|---|---|---|---|---|
| A-1 | — | 0 | 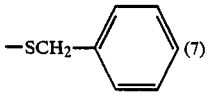 | 1 |
| A-2 | — | 0 | $-OC_8H_{17}$ (7) | 1 |
| A-3 | — | 0 | $-OC_{12}H_{25}$ (7) | 1 |
| A-4 | — | 0 | $-OC_{14}H_{29}$ (7) | 1 |
| A-5 | — | 0 | $-OC_{16}H_{33}$ (7) | 1 |
| A-6 | — | 0 | $-OC_{12}H_{25}$ (7) | 1 |

-continued
| | | | | |
|---|---|---|---|---|
| A-7 | — | 0 | 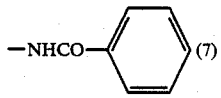 | 1 |
| A-8 | — | 0 | $-OCH_3$ (6,8) | 2 |
| A-9 | — | 0 | 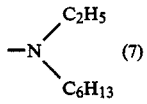 | 1 |
| A-10 | — | 0 | $-OC_{12}H_{25}$ (7), —Cl(6) | 2 |
| A-11 | — | 0 | $-OC(=O)C_{13}H_{27}$ | 1 |
| A-12 | — | 0 | $-C_{12}H_{25}$ (7) | 1 |
| A-13 | — | 0 | $-NHCOOC_{12}H_{25}$ (5) | 1 |
| A-14 | $-CH_3$(1,1,4,4) | 4 | $-OC_{12}H_{25}$ (7) | 1 |
| A-15 | $-CH_3$(2,2,3,3) | 4 | $-OC_{18}H_{25}$ (7) | 1 |
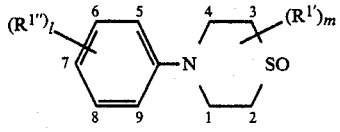
| Compound | $R^{1'}$ | m | $R^{1''}$ | l |
|---|---|---|---|---|
| A-16 | — | 0 | $-OC_{12}H_{25}$ (7) | 1 |
| A-17 | — | 0 | 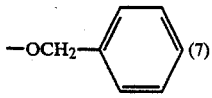 | 1 |
| A-18 | — | 0 | $-NHSO_2C_{16}H_{33}$ (5) | 1 |
| A-19 | $-CH_2OH$ (1) | 1 | $-OC(=O)C_{13}H_{27}$ (6) | 1 |
| A-20 | $-CH_3$(2,2,3,3,) | 4 | $-OC_{12}H_{25}$ (7) | 1 |
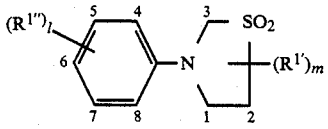
| Compound | $R^{1'}$ | m | $R^{1''}$ | l |
|---|---|---|---|---|
| A-21 | — | 0 | $-OC_{14}H_{29}$ (6) | 1 |
| A-22 | — | 0 | $-OC_2H_5$ (5,7) | 2 |
| A-23 | — | 0 | 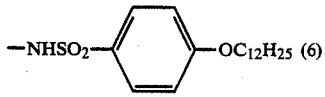 | 1 |
| A-24 | $-OC_2H_5$ (1) | 1 | $-OC_{12}H_{25}$ (4) | 1 |
| A-25 | $-CH_3$ (3,3) | 2 | 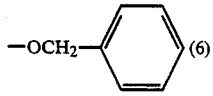 | 1 |
In addition, the following compounds are also available.
A-26
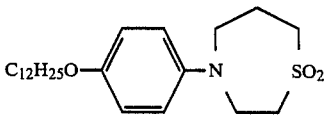

-continued

A-27

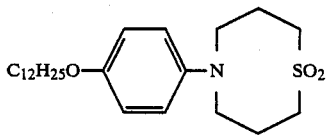

A-28

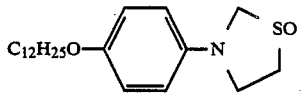

A-29

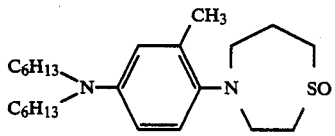

A-30

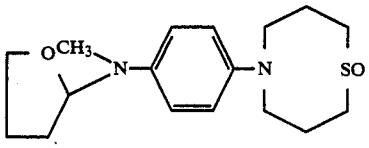

A-31

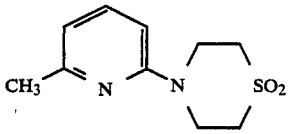

A-32

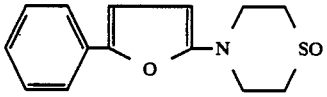

Next, the typical synthesis examples for the magenta dye image stabilizer are described below.

Synthesis example - 1 (Synthesis of compound (A-3))

Twenty seven g of p-dodecyloxyaniline and 15 g of divinylsulfone were dissolved in 200 ml of ethanol, thereby the solution was boiled and refluxed for three hours, and then, cooled with ice, and precipitated crystals were filtered out. The crystals were recrystallized using methanol, thus 18 g of white flake crystals were obtained.

The structure of the crystals was confirmed using mass-spectrum method, and nuclear magnetic resonance spectrum method.

Synthesis example - 2 (Synthesis of compound (A-17))

Twenty g of p-benzyloxyaniline and 13 g of di-vinylsulfoxide were dissolved in 150 ml of ethanol, thereby the solution was boiled and refluxed for five hours, and then, allowed to stand at a room temperature for one night, and precipitated crystals were filtered out. The crystals were recrystallized using methanol, thus 15 g of white powder crystals were obtained.

The structure of the crystals was confirmed using mass-spectrum method, and nuclear magnetic resonance spectrum method.

A preferred amount of addition of magenta dye image stabilizer [A] is 5 to 400 mol %, in particular, 10 to 300 mol % per mol of the magenta coupler of the invention.

According to one of the preferable embodiments of the present invention, two types of magenta dye image stabilizers are used. That is to say, one type is represented by at least one compound selected from those represented by general formula [A], and the other one type is represented by at least one compound selected from those piperazine or homopiperazine compounds represented by general formula [$B_1$].

It is described in Japanese Patent O.P.I. Publications No. 189539/1986 and No. 241754/1986 that a piperazine or homopiperazine compound represented by the general formula [$B_1$] is effective in stabilizing a magenta dye image available from a magenta coupler of the invention.

However, the specifications of the above patents completely fail to mention, in relation to a stabilization of a magenta dye image formed by a magenta coupler of the present invention, an effect achieved by combinedly using at least one piperazine or homopiperazine compound selected from those represented by general formula [$B_1$] of the invention, as well as at least one compound selected from those represented by general formula [A] of the invention.

The inventors devotedly have performed researches and learned that the stability to light of a magenta dye image available from a magenta coupler of the invention is significantly improved by using, in addition to a magenta coupler represented by general formula [M-I], at least one compound selected from those represented by general formula [A] of the invention, as well as at least one compound selected from those represented by general formula [$B_1$] of the invention.

A compound represented by the above general formula [A] and a compound represented by the above general formula [$B_1$] are hereinunder called the magenta dye image stabilizers of the invention, unless otherwise specified.

Being capable of protecting a magenta dye image against fading due to light, the magenta dye image stabilizers of the invention, which are used in conjunction with a magenta coupler of the invention, are capable of preventing discoloration due to light.

In general formula [$B_1$], $R^2$ represents an aliphatic group, a cycloalkyl group, an aryl group or a heterocyclic group. The examples of an aliphatic group represented by $R^2$ include a saturated alkyl group and an unsaturated alkyl group, each of which may have a substituent. The examples of such a saturated alkyl group include a methyl group, an ethyl group, a butyl group, an octyl group, a dodecyl group, a tegradecyl group, and a hexadecyl group. The examples of such an unsaturated alkyl group include an ethynyl group, and a propenyl group.

A cycloalkyl group represented by $R^2$ is, for example, a five to seven-membered cycloalkyl group, and the typical examples include a cyclopentyl group, and a cyclohexyl group, each of which may have a substituent.

The examples of an aryl group represented by $R^2$ include a phenyl group, and a naphthyl group, each of which may have a substituent.

The examples of a heterocyclic group represented by $R^2$ include a 2-pyridyl group, a 4-pyperidyl group, a 2-furil group, a 2-thienyl group, and a 2-pyrimidyl group, each of which may have a substituent.

In general formula [$B_1$], Y represents a plurality of non-metal atoms necessary for forming a piperazine or homopiperazine ring together with a nitrogen atom, and such a piperazine or homopiperazine ring may have a substituent.

Among the compounds of the invention represented by general formula [$B_1$], a particularly advantageous piperazine compound is a compound represented by the following general formula [$B_1$-I].

General formula [$B_1$-I]

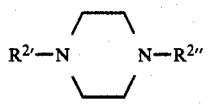

In this formula, $R^{2'}$ represents an alkyl group, a cycloalkyl group, or an aryl group. $R^{2''}$ represents a hydrogen atom, an alkyl group, a cycloalkyl group, or an aryl group.

Among the compounds of the invention represented by general formula [$B_1$], a particularly advantageous homopiperazine compound is a compound represented by the following general formula [$B_1$-II].

General formula [$B_1$-II]

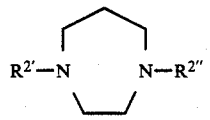

In this formula, $R^{2'}$ and $R^{2''}$ are identical with $R^2$, and $R^{2''}$ in general formula [$B_1$-I].

With each of general formulas [$B_1$-I] and [$B_1$-II], the preferred total number of carbon atoms in $R^{2'}$ and $R^{2''}$ including substituents ranges from 6 to 40.

The typical examples of a compound represented by general formula [$B_1$] are hereinunder listed. However, the scope of the invention is not limited only to these examples.

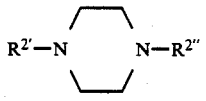

| Compound | $R^{2'}$ | $R^{2''}$ |
|---|---|---|
| P-1 | $-C_{12}H_{25}$ | $-C_{12}H_{25}$ |
| P-2 | $-C_{14}H_{29}$ | $-C_{14}H_{29}$ |
| P-3 | $-C_{14}H_{29}$ | $-H$ |
| P-4 | $-C_{14}H_{29}$ | $-COCH_3$ |
| P-5 | $-C_{16}H_{33}$ | $-C_{16}H_{33}$ |
| P-6 | $-C_{14}H_{29}$ | $-CH_3$ |
| P-7 | 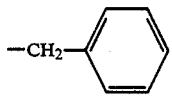 | 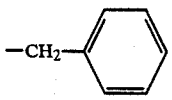 |
| P-8 | 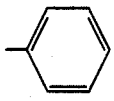 | 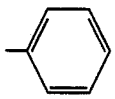 |
| P-9 | $-C_{14}H_{29}$ | 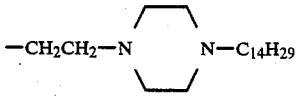 |

-continued

| | | |
|---|---|---|
| P-10 | $-CH_3$ | 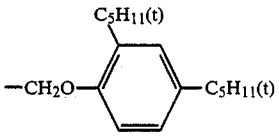 |
| P-11 | $-C_{14}H_{29}$ | $-CONHC_4H_9$ |
| P-12 | $-C_{14}H_{29}$ | $-COCF_3$ |
| P-13 | 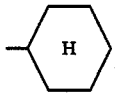 | 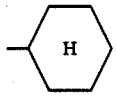 |
| P-14 | 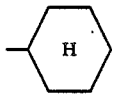 | $-C_{14}H_{29}$ |
| P-15 | $-CH_3$ | 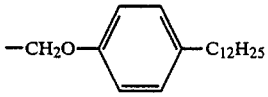 |

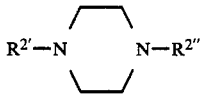

| Compound | $R^{2'}$ | $R^{2''}$ |
|---|---|---|
| P-16 | 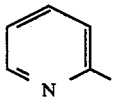 | $-C_{12}H_{25}$ |
| P-17 | 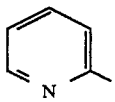 | 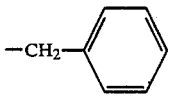 |
| P-18 | 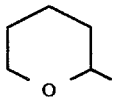 | $-C_{16}H_{33}$ |
| P-19 | 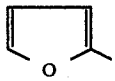 | $-C_{14}H_{29}$ |
| P-20 | 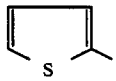 | $-C_{12}H_{25}$ |
| P-21 | $-C_{16}H_{33}$ | $-C_{10}H_{33}$ |
| P-22 | $-C_{12}H_{25}$ | $-C_{12}H_{25}$ |
| P-23 | $-C_{14}H_{29}$ | $-COCH_3$ |
| P-24 | $-C_{14}H_{29}$ | $-COCF_3$ |
| P-25 | $-C_{12}H_{25}$ | 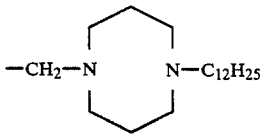 |

-continued

| | | |
|---|---|---|
| P-26 | 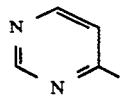 | $-C_{12}H_{25}$ |
| P-27 | 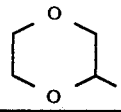 | $-C_{10}H_{33}$ |

In addition, the following compounds are also available.

P-28

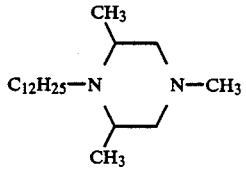

P-29

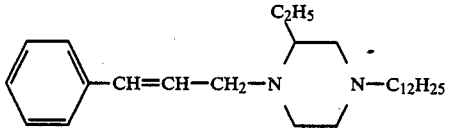

P-30

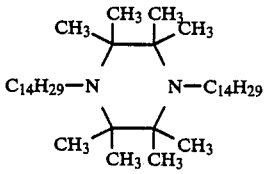

A magenta dye image stabilizer of the invention represented by general formula [$B_1$] is synthesized using a synthesis method described either in Japanese Patent O.P.I. Publication No. 189539/1986 or No. 241754/1986.

The preferred amount of addition of a magenta dye image stabilizer represented either by general formula [A] or [$B_1$] is 5 to 400 mol %, in particular, 10 to 250 mol % per mol magenta coupler of the invention represented by general formula [M-I]. The preferred total amount of addition of both magenta dye image stabilizers of the invention respectively represented by general formulas [A] and [$B_1$] is 100 to 500 mol %, in particular, 20 to 400 mol % per mol magenta coupler of the invention.

The preferred proportion of a magenta dye image stabilizer of the invention represented by general formula [A] to a magenta dye image stabilizer of the invention represented by general formula [$B_1$] is, in terms of molar ratio, 0.1 to 10, in particular, 0.25 to 4.0.

According to another preferable embodiment of the present invention, two types of magenta dye-image stabilizers are used, that is, at least one compound selected from those expressed by General Formula [A] and at least one compound selected from coumarane or chroman compounds expressed by General Formula [$B_2$].

Japanese Patent O.P.I. Publications Nos. 158330/1986 and 241755/1986 respectively disclose the effectiveness of a coumarane or chroman compound expressed by General Formula [$B_2$] of the present invention, for stabilizing a magenta dye-image produced by a magenta coupler of the invention.

However, concerning the stabilization of a magenta dye-image produced by a magenta coupler of the present invention, the above-mentioned specifications are short of providing any information on the effectiveness of combined use of at least one coumarane or chroman compound expressed by General Formula [$B_2$] and at least one compound expressed by General formula [A], each of which is also of the present invention.

As a result of careful examination by the inventors, it was found out that combined use of a magenta coupler expressed by General Formula [M-1] and at least one compound selected from the compounds expressed by General Formula [A] or from those expressed by General Formula [$B_2$]; significantly improves stability to light of a magenta dye-image produced by a magenta coupler of the invention.

In General Formula [$B_2$], the examples of the following atoms and groups are identical with those more specifically described as the examples of the previously mentioned R in General Formula [M-I]:

a halogen atom, an alkyl group, an alkenyl group, an alkoxy group, an alkenyloxy group, an aryl group, an aryloxy group, an acyl group, an acylamino group, an acyloxy group, a sulfonamide group, a cycloalkyl group or alkoxycarbonyl group, each represented by $R^2$ or $R^5$;

an alkyl group, an alkenyl group, an aryl group, an acyl group, a cycloalkyl group or a heterocyclic group, each represented by $R^3$;

and, a halogen atom, an alkyl group, an alkenyl group, an aryl group, an aryloxy group, an acyl group, an acylamino group, an acyloxy group, a sulfonamide group, a cycloalkyl group or an alkoxycarbonyl group, each represented by $R^4$.

$R^3$ and $R^4$ may be linked together to form a five or six-membered ring. Furthermore, $R^3$ and $R^4$ may mutually combine to form a methylendioxy ring.

Y represents a plurality of atoms necessary for forming a chroman or coumarane ring.

The chroman or coumarane ring may have a substituent such as a halogen atom, an alkyl group, a cycloalkyl group, an alkoxy group, an alkenyl group, an alkenyloxy group, a hydroxy group, an aryl group, an aryloxy group or a heterocyclic group, and may form a spiro ring.

Out of the compounds expressed by General Formula [$B_2$], those of General Formulas [$B_2$-I], [$B_2$-II], [$B_2$-III], [$B_2$-IV] and [$B_2$-V] are particularly useful in embodying the present invention.

General Formula [$B_2$-I]

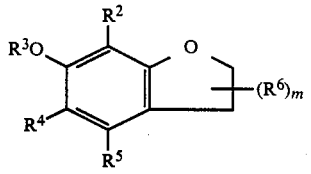

General Formula [$B_2$-II]

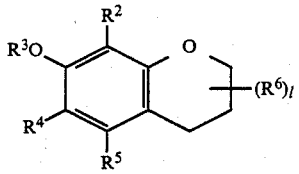

General Formula [$B_2$-III]

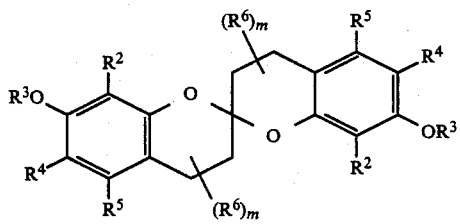

General Formula [$B_2$-IV]

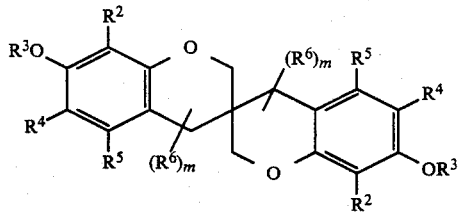

General Formula [$B_2$-V]

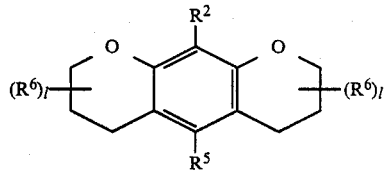

The examples of $R^2$, $R^3$, $R^4$ and $R^5$ in General Formulas [$B_2$-I], [$B_2$-II], [$B_2$-III], [$B_2$-IV] and [$B_2$-V] are identical with those General Formula [$B_2$]. $R^6$ represents a substituent group; m, a zero or an integer 1 to 4; 1, zero or an integer 1 to 6.

If m represents an integer from 2 to 4, or if 1 represents an integer from 2 to 6, a plurality of $R^6$s may or may not be identical with each other. Typical examples of a substituent group represented by $R^6$ correspond to those listed for R in General Formula [M-1] above.

Furthermore, the present invention applies to a case where a carbon atom for forming a coumarane or chroman ring in General Formulae [$B_2$-I], [$B_2$-II] or [$B_2$-V] serves as a spiro atom.

In addition, the invention also applies to a case where a carbon atom other than that which has formed a chroman ring by functioning as a spiro atom in relation to General Formula [$B_2$-III] or [$B_2$-IV], serves as a spiro atom.

Moreover, the invention applies to a case where, in relation to General Formulae [$B_2$-I], [$B_2$-II], [$B_2$-III] or [$B_2$-IV], a coumarane or chroman ring is formed with two adjacent carbon atoms and two $R^6$'s combining together to form a five to seven-membered cycloalkyl ring.

While typical examples of such compounds are presented hereinunder, they do not comprise an exhaustive list of compounds employed in this invention.

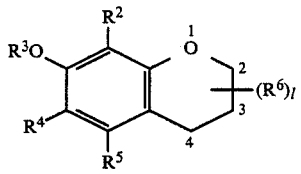

| Compound | $R^2$ | $R^3$ | $R^4$ | $R^5$ | $R^6$ | 1 |
|---|---|---|---|---|---|---|
| CH-1 | H | H | H | H | $-CH_3$ (2,2,4) | 3 |
| CH-2 | H | H | $C_{12}H_{25}$ | H | $-CH_3$ (2,2,4) | 3 |
| CH-3 | H | H | $C_3H_7$ | H | $-CH_3$ (2,2) | 2 |
| CH-4 | H | $C_3H_7$ | (t)$C_8H_{17}$ | H | $-CH_3$ (2,2,3,4) | 4 |
| CH-5 | H | H | 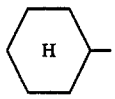 | H | $-CH_3$ (2,4,4)<br>$-CH_2OH$ (2) | 4 |
| CH-6 | H | H | $CH_2{=}CHCH_2COO$ | H | 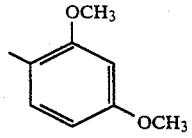 (2) | 4 |

-continued

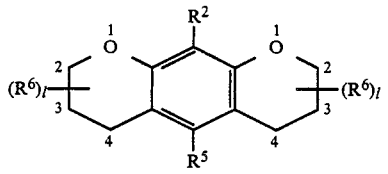

| Compound | $R^2$ | $R^5$ | $R^6$ | l |
|---|---|---|---|---|
| CH-7 | H | H | $-CH_3$ (2,2) | 2 |
| CH-8 | $C_3H_7O-$ | H | $-CH_3$ (2,2,4) | 3 |
| CH-9 | H | OH | $-CH_3$ (2,2) | 2 |
| CH-10 | H | $C_3H_7O-$ | $-CH_3$ (2,2) | 2 |

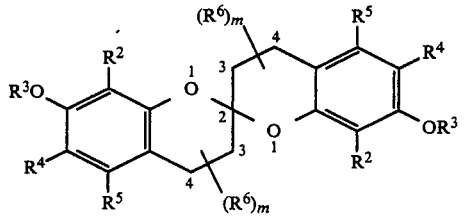

| Compound | $R^2$ | $R^3$ | $R^4$ | $R^5$ | $R^6$ | m |
|---|---|---|---|---|---|---|
| CH-11 | H | H | H | H | $-CH_3$ (4,4) | 2 |
| CH-12 | H | $C_3H_7-$ | H | H | $-CH_3$ (4,4) | 2 |
| CH-13 | H | $CH_3-$ | $CH_3$ | H | $-CH_3$ (4,4) | 2 |
| CH-14 | H | H | $(t)C_4H_9-$ | H | $-CH_3$ (4,4) | 2 |
| CH-15 | H | H | 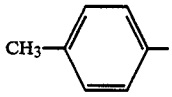 | H | $-CH_3$ (4,4) | 2 |
| CH-16 | H | H | $CH_3SO_2NH-$ | H | — | 0 |
| CH-17 | $CH_3-$ 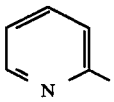 | | $CH_3$ | $CH_3$ | $-CH_3$ (4,4) | 2 |
| CH-18 | H | $C_{12}H_{25}-$ | $CH_3CONH-$ | H | $-CH_3$ (4,4) | 2 |
| CH-19 | H | H | $(t)C_8H_{17}-$ | H | $-CH_3$ (4,4) | 2 |
| CH-20 | H | H | 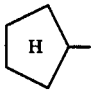 | H | $-CH_3$ (4,4) | 2 |

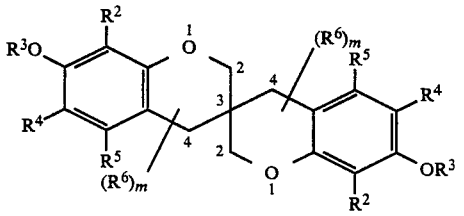

| Compound | $R^2$ | $R^3$ | $R^4$ | $R^5$ | $R^6$ | m |
|---|---|---|---|---|---|---|
| CH-21 | H | H | H | H | $-CH_3$ (4,4) | 2 |
| CH-22 | H | H | $CH_3-$ | H | $-CH_3$ (4,4) | 2 |
| CH-23 | $CH_3-$ 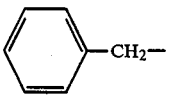 | | H | $CH_3-$ | $-CH_3$ (4,4) | 2 |
| CH-24 | H | H | $CH_3CONH-$ | H | $-CH_3$ (4,4) | 2 |

-continued

| | | | | | | |
|---|---|---|---|---|---|---|
| CH-25 | H | H | 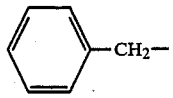 | H | —$CH_3$ (4,4) | 2 |

In addition, the following compounds are available.

CH-26

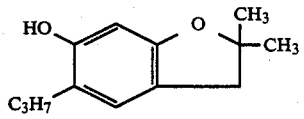

CH-27

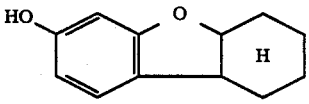

CH-28

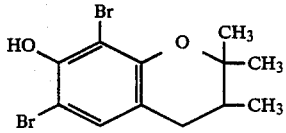

CH-29

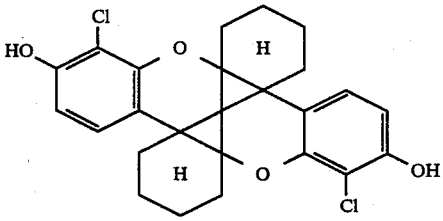

CH-30

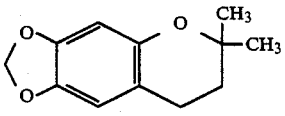

Magenta dye-image stabilizer expressed by General Formula [$B_2$] above include those compounds described in Tetrahedron, 1970, vol 26, pp. 4743–4751; Journal of Chemical Society of Japan, 1972, No. 10, pp. 1987–1990; Chemical Letter, 1972, (4), pp. 315–316 and in Japanese Patent O.P.I. Publication No. 139383/1980, and can be synthesized using the methods described in these literatures and patent.

A preferred amount of addition of the respective magenta dye-image stabilizers expressed by General Formulas [A] and [$B_2$] is 5 to 400 mol %, in particular, is 10 to 250 mol % per mol magenta coupler represented by Formula [M-1] above. Furthermore, a preferred total amount of addition of the two magenta dye-image stabilizers combined, which are respectively expressed by General Formulas [A] and [$B_2$], should be 10 to 500 mol %, in particular, 20 to 400 mol %, per mol magenta coupler according to the invention.

According to further preferable embodiment of the present invention, two types of magenta dye-image stabilizers are used, that is, at least one compound selected from those expressed by General Formula [A] and one compound selected from coumarane or chroman compounds expressed by General Formula [$B_3$].

Japanese Patent O.P.I. Publications Nos. 184543/1986 and 241753/1986 respectively disclose the effectiveness of a hydroxyindan compound expressed by General Formula [$B_3$] of the present invention, for stabilizing a magenta dye-image produced by a magenta coupler of the invention.

However, concerning the stabilization of a magenta dye-image produced by a magenta coupler of the present invention, the above-mentioned specifications are short of providing any information on the effectiveness of combined use of at least one hydroxyin and compound expressed by General Formula [$B_3$] and at least one compound expressed by General Formula [A], each of which is also of the present invention.

As a result of careful examination by the inventors, it was found out that combined use of a magenta coupler expressed by General Formula [M-1] and at least one compound selected from the compounds expressed by General Formula [A] or from those expressed by General Formula [$B_3$], significantly improves stability to light of a magenta dye-image produced by a magenta coupler of the invention.

In General Formula [$B_3$], the examples of the following atoms and groups represented by $R^2$ and $R^4$ are identical with those more specifically described as the examples of the previously mentioned R in General Formula [M-I]: a halogen atom, an alkyl group, an alkenyl group, an alkoxy group, an alkenyloxy group, an aryl group, an aryloxy group, an acyl group, an acylamino group, an acyloxy group, a sulfonamide group, a cycloalkyl group or an alkoxycarbonyl group.

The typical examples of a halogen atom, an alkyl group, an alkenyl group, an aryl group, an acyl group, an acylamino group, an acyloxy group, a sulfonamide group, a cycloalkyl group or a heterocyclic group, each represented by $R^3$ are identical with those described for R in General Formula [M-I].

$R^3$ and $R^4$ may be linked together to form a five or six-membered hydrocarbon ring. Furthermore, this five or six-membered hydrocarbon ring may have such a substituent as a halogen atom, an alkyl group, a cycloalkyl group, an alkoxy group, an alkenyl group, a hydroxy group, an aryl group, an aryloxy group, an acyl group, an acylamino group, an acyloxy group or a heterocyclic group.

Y represents a plurality of atoms necessary for forming an indan ring. This indan ring may have such a substituent as a halogen atom, an alkyl group, an alkenyl group, an alkoxy group, a cycloalkyl group, a hydroxy group, a hydroxy group, an aryl group, an aryloxy group or a heterocyclic group, and may form a spiro ring.

Out of the compounds expressed by General Formula [$B_3$], those of General Formulas [$B_3$-I], [$B_3$-II], and [$B_3$-III], are particularly useful in embodying the present invention.

General Formula [$B_3$-I]

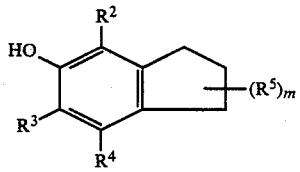

General Formula [B3-II]

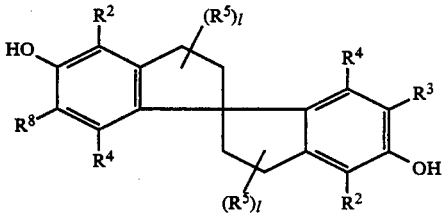

General Formula [B3-III]

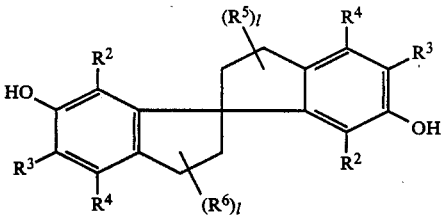

The examples of $R^2$, $R^3$, $R^4$ and $R^5$ in General Formulas [B3-I] through [B3-III] are identical with those General Formula [B3]. $R^5$ represents a substituent group; m, a zero or an integer 1 to 4; l, zero or an integer 1 to 6.

If m represents an integer from 2 to 6, or if l represents an integer from 2 to 4, a plurality of $R^5$s may or may not be identical with each other. Typical examples of a substituent group represented by $R^5$ correspond to those listed for R in General Formula [M-I] above.

Furthermore, the present invention applies to a case where a carbon atom for forming an indan ring in General Formulas [B3-I] serves as a spiro atom.

In addition, the invention also applies to a case where a carbon atom other than that which has formed an indan ring by functioning as a spiro atom in relation to General Formula [B3-II] and [B3-III], serves as a spiro atom.

Moreover, the invention applies to a case where, in relation to General Formulae [B3-I], [B3-II] or [B3-III], an indan ring is formed with two adjacent carbon atoms and two $R^5$s combining together to form a five to seven-membered cycloalkyl ring.

While typical examples of such compounds are presented hereinunder, they do not comprise an exhaustive list of compounds employed in this invention.

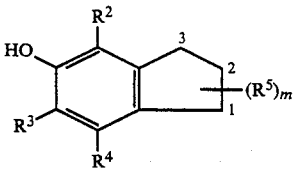

Com-

-continued

| pound | $R^2$ | $R^3$ | $R^4$ | $R^5$ | m |
|---|---|---|---|---|---|
| HI-1 | H | H | H | — | 0 |
| HI-2 | H | H | H | $-CH_3$ (3,3) | 2 |
| HI-3 | H | H | H | $-CH_3$ (3), $-C_{16}H_{33}$ (3) | 2 |
| HI-4 | H | H | H | $-CH_3$ (1,1,3,3) | 4 |
| HI-5 | H | Cl | H | $-CH_3$ (1,1,3,3) | 4 |
| HI-6 | H | H | $-CH_3$ | $-CH_3$ (1,1,3,3) | 4 |
| HI-7 | H | (t)$C_8H_{17}$— | H | $-CH_3$ (1,1,3,3) | 4 |
| HI-8 | H | H | H | $-CH_3$ (1,3,3), 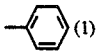 (1) | 4 |
| HI-9 | H | H | $-OCH_3$ | $-CH_3$ (1,1,3,3) | 4 |
| HI-10 | H | $CH_3SO_2NH$— | H | $-CH_3$ (1,1,3,3) | 4 |

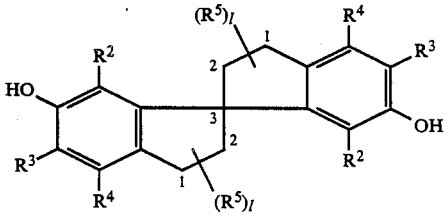

| Com-pound | $R^2$ | $R^3$ | $R^4$ | $R^5$ | l |
|---|---|---|---|---|---|
| HI-11 | H | H | H | $-CH_3$ (1,1) | 2 |
| HI-12 | H | $CH_3$ | H | $-CH_3$ (1,1) | 2 |
| HI-13 | Cl | Cl | H | $-CH_3$ (1,1) | 2 |
| HI-14 | H | OH | H | $-CH_3$ (1,1) | 2 |
| HI-15 | H | $-C_3H_7$ | H | $-CH_3$ (1,1) | 2 |
| HI-16 | H | 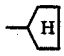 | H | $-CH_3$ (1,1) | 2 |
| HI-17 | H | $CH_3$ | H | $-CH_3$ (1), 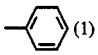 (1) | 2 |
| HI-18 | H | $-CH_2-$ 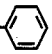 | H | — | 0 |
| HI-19 | H | $-C_8H_{17}$(t) | H | $-CH_3$ (1,1) | 2 |
| HI-20 | H | $-CH_3$ | H | $-C_2H_5$ (1,1) | 2 |

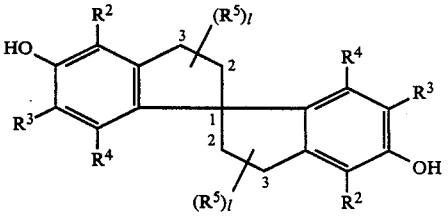

| Com-pound | $R^2$ | $R^3$ | $R^4$ | $R^5$ | l |
|---|---|---|---|---|---|
| HI-21 | $CH_3$ | H | H | $-CH_3$ (3,3) | 2 |
| HI-22 | H | H | H | $-CH_3$ (3,3) | 2 |
| HI-23 | H | $CH_3$ | H | $-CH_3$ (3,3) | 2 |

In addition, the following compounds are available.

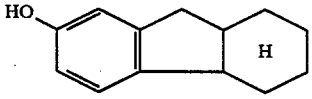

HI-24

-continued

HI-25

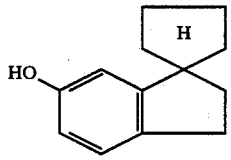

HI-26

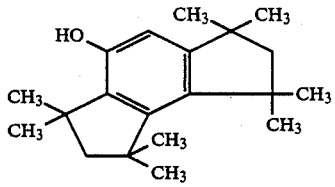

HI-27

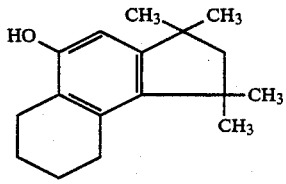

HI-28

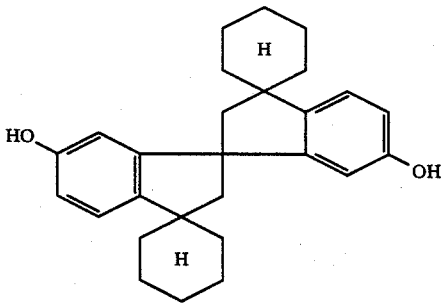

HI-29

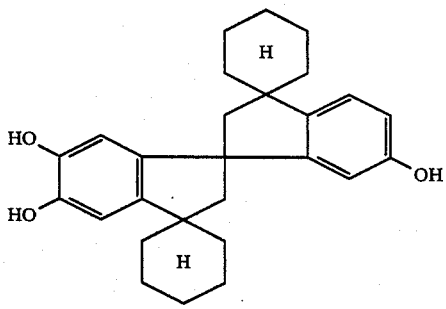

HI-30

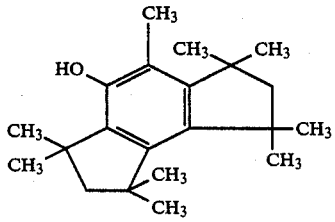

Magenta dye-image stabilizer of the invention expressed by General Formula [$B_3$] above is synthesized in compliance with Journal of Chemical Society of Japan, 1962, pp. 415–417; Japanese Patent Examined Publication No. 32785/1974; and Bulletine of Chemical Society of Japan, 1980, 53, pp 555–556.

A preferred amount of addition of the respective magenta dye-image stabilizers expressed by General Formulas [A] and [$B_3$] is 5 to 400 mol %, in particular, is 10 to 250 mol % per mol magental coupler represented by Formula [M-I] above. Furthermore, a preferred total amount of addition of the two magenta dye-image stabilizers combined, which are respectively expressed by General Formulas [A] and [$B_3$], should be 10 to 500 mol %, in particular, 20 to 400 mol %, per mol magenta coupler according to the invention.

The rate of amount added of a magenta dye image stabilizer of the invention represented by General Formula [A] is, in terms of moles, 0.1 to 01, in particular, 0.25 to 4.0 per mol magenta dye image stabilizer represented by General Formula [$B_3$].

According to still further preferable embodiment of the present invention, three or four types of magenta dye-image stabilizers are used in combination. One type is a compound expressed by the general formula [A]. Another type is a piperazine or homopiperazine compound expressed by the general formula [$B_1$]. The other(s) is (are) a coumarane or chroman compound expressed by the general formula [$B_2$] and/or a hydroxyindan compound expressed by the general formula [$B_3$].

Japanese Patent Publication O.P.I. Publication Nos. 189539/1986 and 241754/1986 describe that a piperazine or homopiperazine compound expressed by the general formula [$B_1$] of this invention is effective in stabilizing a magenta dye-image available from a magenta coupler of this invention.

Japanese Patent O.P.I. Publication Nos. 158330/1986 and 241755/1986 described that a coumarane or chroman compound expressed by the general formula [$B_2$] of this invention is effective in stabilizing magenta dye-image obtained by magenta coupler of this invention.

Japanese Patent O.P.I. Publication Nos. 184543/1986 and 241753/1986 describe that a hydroxyindan compound expressed by the general formula [$B_3$] of this invention is effective in stabilizing a magenta dye-image available from a magenta coupler of this invention.

However, the descriptions in these inventions do not refer to the stabilizing effect attained by the combined use of not only at least one compound expressed by the general formula [A], and at least one piperazine or homopiperazine compound expressed by the general formula [$B_1$], but at least one compound selected from coumarane or chroman compounds expressed by the general formula [$B_2$] of this invention and hydroxyindan compounds expressed by the general formula [$B_3$] of this invention.

The inventor has discovered that the stability of a magenta dye-image available from a magenta coupler of this invention is remarkably improved by the combined addition, to a magenta coupler expressed by the general formula [M-I] of the invention, of a compound expressed by the general formula [A], a compound expressed by the general formula [$B_1$] of the invention, and a compound expressed by the general formula [$B_2$] or [$B_3$] of the invention.

Though a magenta coupler of the invention should be contained preferably in a layer which contains a magenta dye image stabilizer of the invention, the stabilizer may be contained in a layer adjacent to the layer which contains the coupler.

To incorporate hydrophobic compounds including a magenta coupler of the invention and a magenta dye image stabilizer of the invention, such methods are available as the solid dispersion method, latex dispersion method, oil-in-water emulsification dispersion method and the like. For example, according to the oil-in-water emulsification dispersion method, the above compounds are usually dissolved in a high boiling organic solvent (such as phthalic ester, and phosphoric ester) which in compliance with a specific requirement contains low boiling and/or water-soluble organic solvent, whereby the solution is emulsified into a hydrophilic binder such as aqueous gelatin by using surfactant, and the emulsion is added to an intended hydrophilic colloid layer.

In addition to a magenta dye image stabilizer of the invention, the silver halide photographic light-sensitive material of the invention may further contain magenta dye image stabilizers i.e. a phenol compound or a phenyl ether compound represented by general formula [XIII] in pp. 106–120 of Japanese Patent O.P.I. Publication No. 188344/1986.

When any of these phenol compound and phenyl ether compound is used, the preferred amount of addition is less than 200 mol %, in particular, less than 140 mol % per mol magenta dye image stabilizer of the invention.

Both the above phenol compound and the above phenyl ether compound are effective in preventing fading of a magenta dye image available from a magenta coupler of the invention. However these compounds scarely provents discoloration of the similar image. Accordingly, too much of these phenol and phenyl ether compounds should not be used in conjunction with the magenta dye image stabilizer of the invention.

Usually, a magenta dye image available from a magenta coupler of the invention not only quite readily fades due to light, but discolors due to light, and the magenta dye image turns yellower.

The magenta dye image stabilizer of the invention is effective in that it is capable of preventing fading and discoloration, due to light, of a magenta dye image available from the magenta coupler of the invention, and the above phenol and phenyl ether compounds do not provide such an effect at such a degree.

Accordingly, when using the above phenol and phenyl ether compounds in conjunction with a magenta dye stabilizer of the invention, the amount of the phenol and phenyl ether compounds should be selected so that visible discoloration due to light does not occur.

An adequate amount of the phenol and phenyl ether compounds being used in conjunction with a magenta dye image stabilizer of the invention may sometimes provide a synergetic effect.

The silver halide photographic light-sensitive material of the invention is used, for example, as a color negative film or color positive film, or a color print paper. The effect of the invention is best demonstrated when the material is used as a color print paper which is directly appreciated with human vision.

A silver halide emulsion used for preparing the silver halide photographic light-sensitive material of the invention (hereinafter termed "silver halide emulsion of the invention"), may contain silver halide arbitrarily selected from such silver halides used for conventional silver halide emulsions as silver bromide, silver iodobromide, silver iodo-chloride, silver chloro-bromide and silver chloride.

The silver halide emulsions used in embodying the invention are chemically sensitized by means of a sulfur sensitization method, selenium sensitization method, reduction sensitization method, noble metal sensitization method or the like.

The silver halide emulsions used in embodying the invention are optically sensitized to enhance a sensitivity at a specific wave length, by using a dye known as a sensitizing dye in the photographic art.

The silver halide photographic light-sensitive material of the invention may arbitrarily contain additives such as an anti-color fogging agent, hardener, plasticizer, polymer latex, ultraviolet absorbent, formalin scavenger, mordant, development accelerator, development retardant, matting agent, lubricant, anti-static agent, surfactant and the like.

The silver halide photographic light-sensitive material of the invention is capable of forming an image, by undergoing various color development processes.

With the silver halide photographic light-sensitive material containing the magenta coupler of the invention as well as the magenta dye image stabilizer of the invention, fastness of a magenta dye image, which has conventionally vulnerable especially to light, heat and moisture, is improved. More specifically, the magenta dye image is positively protected against discoloration and fading due to light, and, at the same time, the non-dye-image portion is positively protected against occurrence of Y-stain due to light, heat and moisture.

EXAMPLE 1

Gelatin (12.0 mg/100 $cm^2$) and the following comparative magenta coupler a (4.1 mg/100 $cm^2$) were dissolved and emulsified in tricresylhydroquinone (4.0 mg/100 $cm^2$) together with 2,5-di-t-octylhydroquinone (0.1 mg/100 $cm^2$), whereby the emulsion was mixed with a silver chloro-bromide emulsion (silver bromide 80 mol %; amount of silver applied, 3.8 mg/100 $m^2$). The resultant mixture was then applied to a paper support laminated with polyethylene on both sides. The paper support was then dried to provide Sample 1.

Sample 2 was prepared in a manner identical with Sample 1 above, except that the following PH-1 serving as a magenta dye image stabilizer was added in an amount 2.0 times as much as the magenta coupler in terms of mol.

Samples 3, 7, and 11 were prepared in a manner identical with that of Sample 1, except that the magenta coupler in Sample 1 was replaced respectively with magenta couplers of the invention 4, 9, and 20.

Samples 4, 8, and 12 were prepared in a manner identical with that of Samples 3, 7, and 11, except that magenta dye image stabilizer PH-1 was added in an amount 2.0 times as much as a magenta coupler in terms of mol. Additionally, Samples 5, 9, and 13 were prepared by using, in addition to PH-1, magenta dye image stabilizer of the invention A-3 in an amount 2.0 times as much as respective couplers.

Samples 6, 10, and 14 were prepared in a manner identical with that of Samples 3, 7, and 11, except that magenta dye image stabilizer A-16 was added in an amount 2.0 times as much as a coupler in terms of mol.

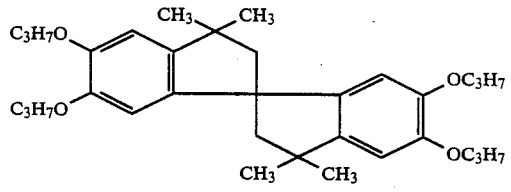

PH-1

Comparative magenta coupler a

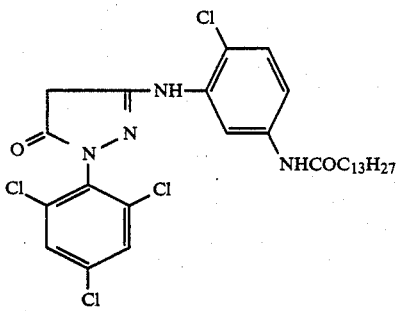

The prepared samples above were exposed to light through an optical wedge, and then treated in the following manner.

| [Treatment] | Temperature | Time |
|---|---|---|
| Color development | 33° C. | 3 min 30 sec |
| Bleach-fixing | 33° C. | 1 min 30 sec |
| Washing | 33° C. | 3 min |
| Drying | 50–80° C. | 2 min |

The constituents of each processing solution are as follows:

| [Color developer] | |
|---|---|
| Benzyl alcohol | 12 ml |
| Diethylene glycol | 10 ml |
| Potassium carbonate | 25 g |
| Sodium bromide | 0.6 g |
| Sodium sulfite anhydride | 2.0 g |
| Hydroxylamine sulfate | 2.5 g |
| N—ethyl-N—β-methanesulfonamidethyl-3-methyl-4-aminoaniline sulfate | 4.5 g |

One liter solution was prepared by adding water to the above components, and was adjusted to pH 10.2 with NaOH.

| [Bleach-fixing solution] | |
|---|---|
| Ammonium thiosulfate | 120 g |
| Sodium metabisulfite | 15 g |
| Sodium sulfite anhydride | 3 g |
| Ferric ammonium EDTA | 65 g |

One liter solution was prepared by adding water to the above components, and was adjusted to pH 6.7 to pH 6.8.

The densities of Samples 1 through 14 treated as above were measured with a densitometer (Model KD-7R of Konica Corporation) under the following conditions.

Each sample treated as above was irradiated with a xenon fade-ometer for 16 days to check the dye image for light fastness, as well as Y-stain in non-dye-image portion. At the same time, each sample was allowed to stand for 14 days under a high temperature, and high humidity atmosphere of 60° C. and 80% RH, and then checked for moisture resistance of a dye image as well as Y-stain in non-dye-image portion. Table 1 lists the results.

The values representing light fastness and moisture resistance of a dye image are defined as follows.

[Residual ratio]

Residual dye percentage, obtained after the light fastness and moisture resistance tests, and relative to an initial density of 1.0.

[Y-stain (Y-S)]

Value obtained by subtracting a Y-stain density before the light fastness and moisture resistance tests, from the Y-stain density after these tests.

[Discoloration ratio]

Value obtained by subtracting pre-light fastness test (yellow density)/(magenta density) value from post-light fastness test (yellow density)/(magenta density) value, relative to the initial density of 1.0. The greater this value is, the more readily a dye image turns from magenta to yellower.

TABLE 1

| Sample No. | Coupler | Dye image stabilizer | Light fastness: Residual ratio (%) | Light fastness: Y-S | Light fastness: Discoloration ratio | Moisture resistance: Residual ratio (%) | Moisture resistance: Y-S |
|---|---|---|---|---|---|---|---|
| 1 (Comparative) | a | — | 40 | 0.46 | 0.27 | 86 | 0.48 |
| 2 (Comparative) | a | PH-1 | 68 | 0.47 | 0.24 | 87 | 0.50 |
| 3 (Comparative) | 4 | — | 16 | 0.04 | 0.68 | 100 | 0.07 |
| 4 (Comparative) | 4 | PH-1 | 65 | 0.10 | 0.67 | 98 | 0.07 |
| 5 (Invention) | 4 | A-3 | 64 | 0.07 | 0.22 | 99 | 0.08 |
| 6 (Invention) | 4 | A-16 | 65 | 0.06 | 0.22 | 102 | 0.08 |
| 7 (Comparative) | 9 | — | 20 | 0.06 | 0.69 | 102 | 0.07 |
| 8 (Comparative) | 9 | PH-1 | 65 | 0.13 | 0.64 | 97 | 0.08 |
| 9 (Invention) | 9 | A-3 | 69 | 0.06 | 0.18 | 98 | 0.09 |
| 10 (Invention) | 9 | A-16 | 68 | 0.07 | 0.19 | 99 | 0.09 |
| 11 (Comparative) | 20 | — | 22 | 0.06 | 0.67 | 100 | 0.08 |
| 12 (Comparative) | 20 | PH-1 | 68 | 0.13 | 0.64 | 100 | 0.08 |
| 13 (Invention) | 20 | A-3 | 71 | 0.08 | 0.16 | 97 | 0.09 |
| 14 (Invention) | 20 | A-16 | 71 | 0.08 | 0.16 | 100 | 0.09 |

It is apparent from the results in Table 1 that Samples 3, 7, and 11, prepared using a magenta coupler of the invention rarely develop Y-stain in the course of light fastness and moisture resistance tests, when compared to Sample 1 prepared using a conventional 4-equivalent-type, 3-anilino-1,2-pyrazolo-5-one coupler. However, it is also apparent from the residual ratios and discoloration ratios, in the same table, resultant from the light fastness test of a non-dye-image portion that these samples 3, 7, and 11, readily discolor and fade due to light. Samples 4, 8, and 12 are samples prepared additionally using magenta dye image stabilizer PH-1 positively reduces fading of a dye image due to light, and, however, fail to improve discoloration.

With Samples 5, 6, 9, 10, 13, and 14, prepared respectively containing both the magenta coupler of the invention and the magenta dye image stabilizer of the invention, it is apparent that each dye image produces smaller discoloration and fading in the course of light fastness, heat resistance and moisture resistance tests, and that a non-dye-image portion is virtually free from Y-stain. Such achievement is not attained using a combination (Sample 2) involving a conventional 4-equivalent-type, 3-anilino-1,2-pyrazolo-5-one coupler as well as dye image stabilizer PH-1.

EXAMPLE 2

Samples 15 through 30 were prepared by applying emulsions in a manner identical with that of Example 1, except that the respective combinations involving magenta couplers and magenta dye image stabilizers listed in Table 2 were used. These samples were subjected to the treatment described in Example 1.

These samples were subjected to light fastness and moisture resistance tests described in Example 1. Table 2 lists the obtained results.

Magenta dye image stabilizers PH-2 and PH-3, as well as comparative magenta coupler b, have the following structures.

PH-2

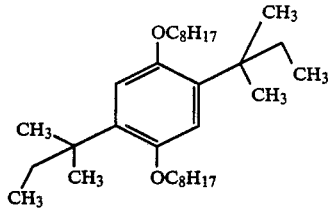

PH-3

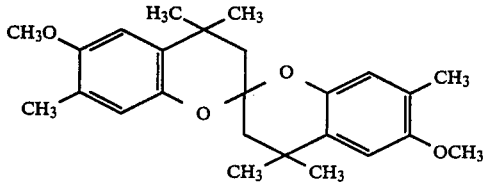

Comparative magenta coupler b

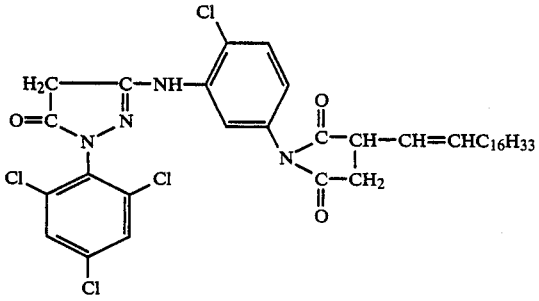

TABLE 2

| Sample No. | Coupler | Dye image stabilizer | Light fastness: Residual ratio (%) | Light fastness: Y-S | Light fastness: Discoloration ratio | Moisture resistance: Residual ratio (%) | Moisture resistance: Y-S |
|---|---|---|---|---|---|---|---|
| 15 (Comparative) | b | A-5 | 38 | 0.50 | 0.32 | 85 | 0.47 |
| 16 (Comparative) | b | A-21 | 37 | 0.47 | 0.35 | 84 | 0.50 |
| 17 (Comparative) | b | PH-2 | 65 | 0.49 | 0.23 | 85 | 0.47 |
| 18 (Comparative) | b | PH-3 | 66 | 0.48 | 0.25 | 86 | 0.46 |
| 19 (Comparative) | 41 | PH-2 | 57 | 0.16 | 0.77 | 101 | 0.13 |
| 20 (Comparative) | 41 | PH-3 | 58 | 0.14 | 0.77 | 102 | 0.13 |
| 21 (Comparative) | 2 | PH-2 | 62 | 0.10 | 0.72 | 100 | 0.10 |
| 22 (Comparative) | 2 | PH-3 | 61 | 0.10 | 0.71 | 99 | 0.10 |
| 23 (Invention) | 41 | A-5 | 66 | 0.08 | 0.19 | 97 | 0.09 |
| 24 (Invention) | 41 | A-21 | 61 | 0.09 | 0.23 | 98 | 0.09 |
| 25 (Invention) | 2 | A-5 | 66 | 0.09 | 0.19 | 98 | 0.10 |
| 26 (Invention) | 2 | A-21 | 62 | 0.08 | 0.22 | 100 | 0.08 |
| 27 (Invention) | 2 | A-10 | 65 | 0.08 | 0.20 | 101 | 0.07 |
| 28 (Invention) | 2 | A-15 | 67 | 0.08 | 0.20 | 99 | 0.09 |
| 29 (Invention) | 2 | A-20 | 63 | 0.08 | 0.24 | 100 | 0.08 |
| 30 (Invention) | 2 | A-26 | 63 | 0.07 | 0.24 | 97 | 0.08 |

It is apparent from the results in Table 2 that Samples 15 and 16 prepared using both a 4-equivalent type, 3-anilino-1,2-pyrazolo-5-one coupler and a magenta dye image stabilizer of the invention, as well as Samples 19, 20, 21 and 22 prepared using both the magenta coupler of the invention and a conventionally often used magenta dye stabilizer, do not satisfy all of the criteria in the light fastness test i.e. improvement in discoloration, fading, and Y-stain on non-dye-image portion, as well as the criterion in the moisture resistance test i.e. improvement in Y-stain. It is also apparent that each of the above criteria is satisfied only by combindely using a magenta coupler of the invention and a magenta dye image stabilizer of the invention.

EXAMPLE 3

Multi-color silver halide photographic light-sensitive material was prepared by layering the following coating materials sequentially onto a paper support having polyethylene lamination on both sides. This was designated Sample 31.

First layer: Blue-sensitive silver halide emulsion layer

α-pivaloyl-α-(2,4-dioxo-1-benzylimidazoline-3-yl)-2-chloro-5-[γ-(2,4-di-t-amylphenoxy)butylamide]acetanilide as a yellow coupler was applied at a rate of 6.8 mg/100 cm$^2$; a blue-sensitive silver chloro-bromide emulsion (containing 85 mol % of silver bromide), at a rate of 3.2 mg/100 cm$^2$ as converted to the amount of silver; dibutyl phthalate, at a rate of 3.5 mg/100 cm$^2$; gelatin, at a rate of 13.5 mg/100 cm$^2$.

Second layer: Intermediate layer 2,5-di-t-octylhydroquinone was applied at a rate of 0.5 mg/100 cm$^2$; dibutyl phthalate, at a rate of 0.5 mg/100 cm$^2$; gelatin, at a rate of 9.0 mg/100 cm$^2$.

Third layer: Green-sensitive silver halide emulsion layer

The previously mentioned magenta coupler 1 was applied at a rate of 3.5 mg/100 cm$^2$; a green-sensitive silver chlorobromide emulsion (containing 80 mol % of silver bromide), at a rate of 2.5 mg/100 cm$^2$ as converted to the amount of silver; dibutyl phthalate, at a rate of 4.0 mg/100 cm$^2$; gelatin, at a rate of 12.0 mg/100 cm$^2$.

Fourth layer: Intermediate layer 2-(2-hydroxyethyl-3-sec-butyl-5-t-butylphenyl)benzotriazole as an ultraviolet absorbent was applied at a rate of 4.0 mg/100 cm$^2$; dibutyl phthalate, at a rate of 5.0 mg/100 cm$^2$; 2,5-di-t-octylhydroquinone, at a rate of 0.5 mg/100 cm$^2$; gelatin, at a rate of 12.0 mg/100 cm$^2$.

Fifth layer: Red-sensitive silver halide emulsion layer

2-[α-(2,4-di-t-pentylphenoxy)butanamide]-4,6-dichloro-5-ethylphenol as a cyan coupler was applied at a rate of 4.2 mg/100 cm$^2$; a red-sensitive silver chlorobromide emulsion (containing 80 mol % of silver bromide), at a rate of 3.0 mg/100 cm$^2$ as converted to the amount of silver; tricresylphosphate, at a rate of 3.5 mg/100 cm$^2$; gelatin, at a rate of 11.5 mg/100 cm$^2$.

Six layer: Protective layer

Gelatin was applied at a rate of 8.0 mg/100 cm$^2$.

Multi-layer Samples 32 through 40 were prepared by incorporating the magenta dye image stabilize of the invention into the third layer of the previously mentioned Sample 31 at rates shown in Table 3, and exposed to light and treated as in Example 1. Then, the samples were subjected to light fastness test (they were irradiated with a xenon fade-ometer for 15 days). Table 3 also lists the test results.

TABLE 3

| Sample No. | Dye-image stabilizer | Amount added mol % per coupler | Magenta dye-image residual ratio by light fastness |
|---|---|---|---|
| 31 (Comparative) | — | — | 14% |
| 32 (Invention) | A-2 | 60 | 42 |
| 33 (Invention) | A-2 | 120 | 56 |

TABLE 3-continued

| Sample No. | Dye-image stabilizer | Amount added mol % per coupler | Magenta dye-image residual ratio by light fastness |
|---|---|---|---|
| 34 (Invention) | A-2 | 180 | 69 |
| 35 (Invention) | A-5 | 60 | 44 |
| 36 (Invention) | A-5 | 120 | 55 |
| 37 (Invention) | A-5 | 180 | 70 |
| 38 (Invention) | A-16 | 60 | 39 |
| 39 (Invention) | A-16 | 120 | 53 |
| 40 (Invention) | A-16 | 180 | 66 |

As can be understood from the results listed in the table, the magenta dye image of the invention is effective in stabilizing a dye image available from the magenta coupler of the invention, and the effect is greater in proportion to an increase in amount of addition. Samples 32 through 40, when compared with Sample 31, provided dye images with which only minimum discoloration occurred.

Furthermore, with the samples according to the invention, discoloration and fading of a magenta dye image is extremely small. Accordingly, the results of light fastness test proved the silver halide photographic light-sensitive material of the invention as a whole attained excellent color balance of magenta coupler relative to yellow and cyan couplers, hence extremely excellent color reproducibility.

EXAMPLE 4

The following coating materials were sequentially layered, in the following order, on a paper support laminated with polyethylene on both sides.

First layer: Emulsion layer

Magenta coupler 9 of the invention was applied at a rate of 4.5 mg/100 $cm^2$; a silver chloro-bromide emulsion (containing 85 mol % of silver bromide), at a rate of 3.5 mg/100 $cm^2$ as converted to the amount of silver; dibutyl phthalate, at a rate of 4.5 mg/100 $cm^2$; gelatin, at a rate of 12.0 mg/100 $cm^2$.

Second layer: Intermediate layer (layer containing ultraviolet absorbent)

2-(2-hydroxy-3-sec-butyl-5-t-butylphenyl)benzotriazole, serving as an ultraviolet absorbent, was applied at a rate of 5.0 mg/100 $cm^2$; dibutyl phthalate, at a rate of 5.0 mg/100 $cm^2$; gelatin, at a rate of 12.0 mg/100 $cm^2$.

Third layer: Protective layer

Gelatin was applied at a rate of 8.0 mg/100 $cm^2$.

The sample thus obtained was designated Sample 1.

Samples 2 through 11 were prepared in the same manner as Sample 1 except that in these samples dye-image stabilizer(s) as shown in Table 4 were added in an equal amount in terms of mol number to that of the magenta coupler.

In Samples 4 to 11, two magenta dye-image stabilizers were used in combination at an adding mol ratio of 1:1, making the total amount equivalent in terms of mol number to that of the magenta coupler.

Comparative compound a (Compound described in Japanese Patent O.P.I. Publication No. 48538/1979)

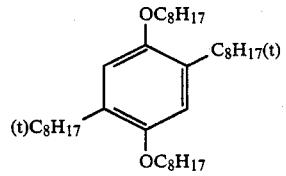

Comparative compound b (Compound described in Japanese Patent O.P.I. Publication No. 159644/1981)

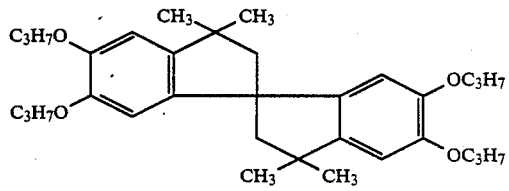

The prepared samples above were exposed to light through an optical wedge in compliance with a conventional method, and then treated in the following manner.

| [Treatment] | Temperature | Time |
|---|---|---|
| Color development | 33° C. | 3 min 30 sec |
| Bleach-fixing | 33° C. | 1 min 30 sec |
| Washing | 33° C. | 3 min |
| Drying | 50–80° C. | 2 min |

The constituents of each processing solution are as follows:

| [Color developer] | |
|---|---|
| Benzyl alcohol | 12 ml |
| Diethylene glycol | 10 ml |
| Pottasium carbonate | 25 g |
| Sodium bromide | 0.6 g |
| Sodium sulfite anhydride | 2.0 g |
| Hydroxylamine sulfate | 2.5 g |
| N—ethyl-N—β-methanesulfonamidethyl-3-methyl-4-aminoaniline sulfate | 4.5 g |

One liter solution was prepared by adding water to the above components, and was adjusted to pH 10.2 with NaOH.

| [Bleach-fixing solution] | |
|---|---|
| Ammonium thiosulfate | 120 g |
| Sodium metabisulfite | 15 g |
| Sodium sulfite anhydride | 3 g |
| Ferric ammonium EDTA | 65 g |

One liter solution was prepared by adding water to the above components, and was adjusted to pH 6.7 to pH 6.8.

The densities of Samples 1 through 11 treated as above were measured with a densitometer (Model KD-7R of Konica Corporation) under the following conditions.

Each sample treated as above was irradiated with a xenon fade-ometer for 12 days to check the dye image for light fastness.

The values representing light fastness and moisture resistance of a dye image are defined as follows.

[Residual rate]

Residual dye percentage, obtained after the light fastness and moisture resistance tests, and relative to an initial density of 1.0.

[Degree of discoloration]

Value obtained by subtracting pre-light fastness test (yellow density)/(magenta density) value from post-light fastness test (yellow density)/(magenta density) value, relative to the initial density of 1.0. The greater this value is, the more readily a dye image turns from magenta to yellower.

TABLE 4

| Sample No. | Coupler | Dye image stabilizer | Light fastness Residual Ratio (%) | Light fastness Discoloration ratio |
|---|---|---|---|---|
| 1 (Comp.) | 9 | — | 16 | 0.79 |
| 2 (Inv.) | 9 | A-3 | 59 | 0.21 |
| 3 (Inv.) | 9 | A-16 | 56 | 0.21 |
| 4 (Inv.) | 9 | A-3 + Comparative Compound a | 63 | 0.25 |
| 5 (Inv.) | 9 | A-16 + Comparative Compound a | 60 | 0.27 |
| 6 (Inv.) | 9 | A-3 + Comparative Compound b | 63 | 0.27 |
| 7 (Inv.) | 9 | A-16 + Comparative Compound b | 60 | 0.27 |
| 8 (Inv.) | 9 | A-3 + P-1 | 73 | 0.16 |
| 9 (Inv.) | 9 | A-3 + P-22 | 71 | 0.13 |
| 10 (Inv.) | 9 | A-16 + P-1 | 68 | 0.14 |
| 11 (Inv.) | 9 | A-16 + P-22 | 69 | 0.14 |

Note: In Tables 4 through 15, an indication, for example, "A-3 + P—1" means a combined use of two compounds.

From Table 4, it is apparent that the combined use of dye-image stabilizers in accordance with the present invention gives advantageous effects.

EXAMPLE 5

Samples 12 through 34 were prepared by combining a coupler and magenta dye-image stabilizers as is presented in Table 5, whereby the layers were disposed in a manner identical with Example 4.

Samples 12 through 34 were prepared according to the same method presented in Example 4.

Furthermore, when the same light fastness test as Example 4 was performed with these samples, the following results presented in Table 5 were obtained.

TABLE 5

| Sample No. | Coupler | Dye image stabilizer | Light fastness Dye-image Residual Ratio (%) |
|---|---|---|---|
| 12(Inv.) | 2 | A-4 | 45 |
| 13(Inv.) | 2 | A-21 | 42 |
| 14(Inv.) | 2 | A-4 + P-2 | 67 |
| 15(Inv.) | 2 | A-4 + P-24 | 64 |
| 16(Inv.) | 2 | A-21 + P-2 | 65 |
| 17(Inv.) | 2 | A-21 + P-24 | 63 |
| 18(Inv.) | 10 | A-4 | 50 |
| 19(Inv.) | 10 | A-21 | 48 |
| 20(Inv.) | 10 | A-4 + P-2 | 70 |
| 21(Inv.) | 10 | A-4 + P-24 | 67 |
| 22(Inv.) | 10 | A-21 + P-2 | 67 |
| 23(Inv.) | 10 | A-21 + P-24 | 67 |
| 24(Inv.) | 23 | A-4 | 50 |
| 25(Inv.) | 23 | A-21 | 48 |
| 26(Inv.) | 23 | A-4 +P-2 | 70 |
| 27(Inv.) | 23 | A-4 +P-24 | 67 |
| 28(Inv.) | 23 | A-21 +P-2 | 67 |
| 29(Inv.) | 23 | A-21 +P-24 | 67 |
| 30(Inv.) | 23 | A-9 +P-6 | 7 |
| 31(Inv.) | 23 | A-10 +P-11 | 71 |
| 32(Inv.) | 23 | A-20 +P-6 | 71 |
| 33(Inv.) | 23 | A-26 +P-16 | 69 |
| 34(Inv.) | 23 | A-28 +P-28 | 69 |

From Table 5, it is apparent that the combined use of dye-image stabilizers in accordance with the present invention gives advantageous effects.

EXAMPLE 6

Sample 35, a silver halide multi-color photographic light-sensitive material, was prepared by applying the following coating materials sequentially onto a paper support having polyethylene lamination on both sides.

First layer: Blue-sensitive silver halide emulsion layer

α-pivaloyl-α-(2,4-dioxo-1-benzylimidazoline-3-yl)-2-chloro-5-[γ-(2,4-di-t-amylphenoxy)butylamide]acetanilide serving as a yellow coupler was applied at a rate of 6.8 mg/100 cm$^2$; a blue-sensitive silver chloro-bromide emulsion (containing 85 mol % of silver bromide), at a rate of 3.2 mg/100 cm$^2$ as converted to the amount of silver; dibutyl phthalate, at a rate of 3.5 mg/100 cm$^2$; gelatin, at a rate of 13.5 mg/100 cm$^2$.

Second layer: Intermediate layer 2,5-di-t-octylhydroquinone was applied at a rate of 0.5 mg/100 cm$^2$; dibutyl phthalate, at a rate of 0.5 mg/100 cm$^2$; gelatin, at a rate of 9.0 mg/100 cm$^2$.

Third layer: Green-sensitive silver halide emulsion layer

Magenta coupler 11 of the invention was applied at a rate of 4.2 mg/100 cm$^2$; a green-sensitive silver chloro-bromide emulsion (containing 80 mol % of silver bromide), at a rate of 2.5 mg/100 cm$^2$ as converted to the amount of silver; dibutyl phthalate, at a rate of 4.0 mg/100 cm$^2$; gelatin, at a rate of 12.0 mg/100 cm$^2$.

Fourth layer: Intermediate layer 2-(2-hydroxy-3-sec-butyl-5-t-butylphenyl)benzotriazole serving as an ultraviolet absorbent was applied at a rate of 3.0 mg/100 cm$^2$; dibutyl phthalate, at a rate of 3.0 mg/100 cm$^2$; 2,5-di-t-octylhydroquinone, at a rate of 0.5 mg/100 cm$^2$; gelatin, at a rate of 12.0 mg/100 cm$^2$.

Fifth layer: Red-sensitive silver halide emulsion layer

2[α-(2,4-di-t-pentylphenoxy)butanamide]-4,6-dichloro-5-ethylphenol serving as a cyan coupler was applied at a rate of 4.2 mg/100 cm$^2$; a red-sensitive silver chloro-bromide emulsion (containing 80 mol % of silver bromide), at a rate of 3.0 mg/100 cm$^2$ as converted to the amount of silver; tricresyl phosphate, at a rate of 3.5 mg/100 cm$^2$; gelatin, at a rate of 11.5 mg/100 cm$^2$.

Sixth layer: Intermediate layer having constitution identical with that of fourth layer Seven layer: Protective layer Gelatin was applied at a rate of 8.0 mg/100 cm$^2$.

Multi-layered Samples 36 through 43 were prepared by adding the magenta dye image stabilizers of the present invention to the third layer of the previously mentioned Sample 35 at respective rates shown in Table 6, and exposed to light and treated as in Example 4. Then the samples were irradiated with a xenon fadeometer for 14 days to test fastness to light.

Table 6 also lists the test results.

TABLE 6

| Sample No. | Dye-image stabilizer | Amount added Mol %/coupler | Magenta dye-image residual rate on light fastness (%) |
|---|---|---|---|
| 35(Comp.) | — | — | 13 |
| 36(Inv.) | A-4 | 100 | 52 |
| 37(Inv.) | A-4 | 150 | 59 |
| 38(Inv.) | A-4 + P-1 | 75 +25 | 67 |
| 39(Inv.) | A-4 + P-1 | 50 +50 | 72 |
| 40(Inv.) | A-4 + P-1 | 25 + 75 | 65 |
| 41(Inv ) | A-4 + P-1 | 100 + 50 | 74 |
| 42(Inv.) | A-4 + P-1 | 75 + 75 | 77 |
| 43(Inv.) | A-4 + P-1 | 50 + 100 | 72 |

From Table 6, it is apparent that the combined use of dye-image stabilizers in accordance with the present invention gives advantageous effects.

Results listed in Table 6 indicate that, if a total amount of addition of the magenta dye image stabilizers is constant, the combined use of two types of magenta dye-image stabilizers of present invention at an appropriate ratio improves light fastness of a magenta dye-image much greatly than the use of only one magenta dye-image stabilizer of present invention.

The silver halide photographic light-sensitive material of the invention attains superior color reproducibility with fewer Y-stain occurrence.

EXAMPLE 7

The following layers were sequentially disposed, in the following order, on a paper support having lamination of polyethylene on both sides.

First layer: Emulsion layer

Magenta coupler 9 of the invention was applied at a rate of 4.5 mg/100 $cm^2$; a silver chloro-bromide emulsion (containing 85 mol % of silver bromide), at a rate of 3.5 mg/100 $cm^2$ as converted to the amount of silver; dibutyl phthalate, at a rate of 4.5 mg/100 $cm^2$; gelatin, at a rate of 12.0 mg/100 $cm^2$.

Second layer: Intermediate layer (layer containing ultraviolet absorbent)

2-(2-hydroxy-3-sec-butyl-5-t-butylphenyl)benzotriazole, serving as an ultraviolet absorbent, was applied at a rate of 5.0 mg/100 $cm^2$; dibutyl phthalate, at a rate of 5.0 mg/100 $cm^2$; gelatin, at a rate of 12.0 mg/100 $cm^2$.

Third layer: Protective layer

Gelatin was applied at a rate of 8.0 mg/100 $cm^2$.

The sample thus obtained was designated Sample 1.

Samples 2 through 11 were prepared in the same manner as Sample 1 except that in these samples dye-image stabilizer(s) as shown in Table 7 were added in an equal amount in terms of mol number to that of the magenta coupler.

In Samples 4 to 11, two magenta dye-image stabilizers were used in combination at an adding mol ratio of 1:1, making the total amount equivalent in terms of mol number to that of the magenta coupler.

Comparative compound a (Compound described in Japanese Patent O.P.I. Publication No. 48538/1979)

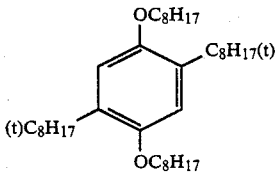

Comparative compound b (Compound described in Japanese Patent O.P.I. Publication No. 159644/1981)

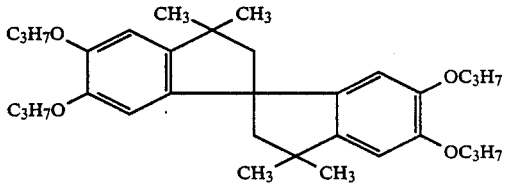

The prepared samples above were exposed to light through an optical wedge in compliance with a conventional method, and then treated in the following manner.

| [Treatment] | Temperature | Time |
|---|---|---|
| Color development | 33° C. | 3 min 30 sec |
| Bleach-fixing | 33° C. | 1 min 30 sec |
| Washing | 33° C. | 3 min |
| Drying | 50–80° C. | 2 min |

The constituents of each processing solution are as follows:

| [Color developer] | |
|---|---|
| Benzyl alcohol | 12 ml |
| Diethylene glycol | 10 ml |
| Pottasium carbonate | 25 g |
| Sodium bromide | 0.6 g |
| Sodium sulfite anhydride | 2.0 g |
| Hydroxylamine sulfate | 2.5 g |
| N—ethyl-N—β-methanesulfonamidetyl-3-methyl-4-aminoaniline sulfate | 4.5 g |

One liter solution was prepared by adding water to the above components, and was adjusted to pH 10.2 with NaOH.

| [Bleach-fixing solution] | |
|---|---|
| Ammonium thiosulfate | 120 g |
| Sodium metabisulfite | 15 g |
| Sodium sulfite anhydride | 3 g |
| Ferric ammonium EDTA | 65 g |

One liter solution was prepared by adding water to the above components, and was adjusted to pH 6.7 to pH 6.8.

The densities of Samples 1 through 11 treated as above were measured with a photographic densitometer (Model KD-7R of Konica Corporation) under the following conditions.

Each sample treated as above was irradiated with a xenon fade-ometer for 12 days to check the dye image for light fastness.

The values representing light fastness and moisture resistance of a dye image are defined as follows.

[Residual ratio]

Residual dye percentage, obtained after the light fastness and moisture resistance tests, and relative to an initial density of 1.0.

[Discoloration ratio]

Value obtained by subtracting pre-light fastness test (yellow density)/(magenta density) value from post-light fastness test (yellow density)/(magenta density) value, relative to the initial density of 1.0. The greater this value is, the more readily a dye image turns from magenta to yellower.

Table 7 lists the results.

TABLE 7

| Sample No. | Coupler | Dye image stabilizer | Light fastness Residual Ratio (%) | Light fastness Discoloration ratio |
|---|---|---|---|---|
| 1 (Comp.) | 9 | — | 16 | 0.79 |
| 2 (Inv.) | 9 | A-3 | 59 | 0.21 |
| 3 (Inv.) | 9 | A-16 | 56 | 0.21 |
| 4 (Inv.) | 9 | A-3 + Comparative Compound a | 63 | 0.25 |
| 5 (Inv.) | 9 | A-16 + Comparative Compound a | 60 | 0.27 |
| 6 (Inv.) | 9 | A-3 + Comparative Compound b | 63 | 0.27 |
| 7 (Inv.) | 9 | A-16 + Comparative Compound b | 60 | 0.27 |
| 8 (Inv.) | 9 | A-3 + CH-2 | 73 | 0.15 |
| 9 (Inv.) | 9 | A-3 + CH-11 | 74 | 0.14 |
| 10 (Inv.) | 9 | A-16 + CH-2 | 68 | 0.15 |
| 11 (Inv.) | 9 | A-16 + CH-11 | 68 | 0.14 |

From Table 7, it is apparent that the combined use of dye-image stabilizers in accordance with the present invention gives advantageous effects.

EXAMPLE 8

Samples 12 through 34 were prepared by combining a coupler and magenta dye-image stabilizers as is presented in Table 8, whereby the layers were disposed in a manner identical with Example 7.

Samples 12 through 34 were prepared according to the same method presented in Example 7.

Furthermore, when the same light fastness test as Example 7 was performed with these samples, the following results presented in Table 8 were obtained.

TABLE 8

| Sample No. | Coupler | Dye image stabilizer | Light fastness Dye-image Residual Ratio (%) |
|---|---|---|---|
| 12 (Inv.) | 2 | A-4 | 45 |
| 13 (Inv.) | 2 | A-21 | 42 |
| 14 (Inv.) | 2 | A-4 + CH-19 | 65 |
| 15 (Inv.) | 2 | A-4 + CH-22 | 63 |
| 16 (Inv.) | 2 | A-21 + CH-19 | 62 |
| 17 (Inv.) | 2 | A-21 + CH-22 | 61 |
| 18 (Inv.) | 10 | A-4 | 50 |
| 19 (Inv.) | 10 | A-21 | 48 |
| 20 (Inv.) | 10 | A-4 + CH-19 | 71 |
| 21 (Inv.) | 10 | A-4 + CH-22 | 69 |
| 22 (Inv.) | 10 | A-21 + CH-19 | 67 |
| 23 (Inv.) | 10 | A-21 + CH-22 | 66 |
| 24 (Inv.) | 23 | A-4 | 50 |
| 25 (Inv.) | 23 | A-21 | 48 |
| 26 (Inv.) | 23 | A-4 + CH-19 | 75 |
| 27 (Inv.) | 23 | A-4 + CH-22 | 73 |
| 28 (Inv.) | 23 | A-21 + CH-19 | 70 |
| 29 (Inv.) | 23 | A-21 + CH-22 | 70 |
| 30 (Inv.) | 23 | A-9 + CH-4 | 74 |
| 31 (Inv.) | 23 | A-10 + CH-7 | 73 |
| 32 (Inv.) | 23 | A-20 + CH-12 | 70 |
| 33 (Inv.) | 23 | A-26 + CH-14 | 68 |
| 34 (Inv.) | 23 | A-28 + CH-26 | 69 |

From Table 8, it is apparent that the combined use of dye-image stabilizers in accordance with the present invention gives advantageous effects.

EXAMPLE 9

Sample 35, a silver halide multi-color photographic light-sensitive material, was prepared by applying the following coating materials sequentially onto a paper support having polyethylene lamination on both sides.

First layer: Blue-sensitive silver halide emulsion layer

α-pivaloyl-α-(2,4-dioxo-1-benzylimidazoline-3-yl)-2-chloro-5-[γ-(2,4-di-t-amylphenoxy)butylamide]acetanilide serving as a yellow coupler was applied at a rate of 6.8 mg/100 cm$^2$; a blue-sensitive silver chloro-bromide emulsion (containing 85 mol % of silver bromide), at a rate of 3.2 mg/100 cm$^2$ as converted to the amount of silver; dibutyl phthalate, at a rate of 3.5 mg/100 cm$^2$; gelatin, at a rate of 13.5 mg/100 cm$^2$.

Second layer: Intermediate layer 2,5-di-t-octylhydroquinone was applied at a rate of 0.5 mg/100 cm$^2$; dibutyl phthalate, at a rate of 0.5 mg/100 cm$^2$; gelatin, at a rate of 9.0 mg/100 cm$^2$.

Third layer: Green-sensitive silver halide emulsion layer

Magenta coupler 11 of the invention was applied at a rate of 4.2 mg/100 cm$^2$; a green-sensitive silver chloro-bromide emulsion (containing 80 mol % of silver bromide), at a rate of 2.5 mg/100 cm$^2$ as converted to the amount of silver; dibutyl phthalate, at a rate of 4.0 mg/100 cm$^2$; gelatin, at a rate of 12.0 mg/100 cm$^2$.

Fourth layer: Intermediate layer 2-(2-hydroxy-3-sec-butyl-5-t-butylphenyl)benzotriazole serving as an ultraviolet absorbent was applied at a rate of 3.0 mg/100 cm$^2$; dibutyl phthalate, at a rate of 3.0 mg/100 cm$^2$; 2,5-di-t-octylhydroquinone, at a rate of 0.5 mg/100 cm$^2$; gelatin, at a rate of 12.0 mg/100 cm$^2$.

Fifth layer: Red-sensitive silver halide emulsion layer

2-[α-(2,4-di-t-pentylphenoxy)butanamide]-4,6-dichloro-5-ethylphenol serving as a cyan coupler was applied at a rate of 4.2 mg/100 cm$^2$; a red-sensitive silver chloro-bromide emulsion (containing 80 mol % of silver bromide), at a rate of 3.0 mg/100 cm$^2$ as converted to the amount of silver; tricresyl phosphate, at a rate of 3.5 mg/100 cm$^2$; gelatin, at a rate of 11.5 mg/100 cm$^2$.

Sixth layer: Intermediate layer having constitution identical with that of fourth layer Seventh layer: Protective layer Gelatin was applied at a rate of 8.0 mg/100 cm$^2$.

Multi-layered Samples 36 through 43 were prepared by adding the magenta dye image stabilizers of the present invention to the third layer of the previously mentioned Sample 35 at respective rates shown in Table 9, and exposed to light and treated as in Example 7. Then the samples were irradiated with a xenon fadeometer for 14 days to test fastness to light.

Table 9 also lists the test results.

TABLE 9

| Sample No. | Dye-image stabilizer | Amount added Mol %/coupler | Magenta dye-image residual rate on light fastness (%) |
|---|---|---|---|
| 35 (Comp.) | — | — | 13 |
| 36 (Inv.) | A-4 | 100 | 52 |
| 37 (Inv.) | A-4 | 150 | 59 |
| 38 (Inv.) | A-4 + CH-11 | 75 + 25 | 68 |
| 39 (Inv.) | A-4 + CH-11 | 50 + 50 | 74 |
| 40 (Inv.) | A-4 + CH-11 | 25 + 75 | 66 |
| 41 (Inv ) | A-4 + CH-11 | 100 + 50 | 75 |
| 42 (Inv ) | A-4 + CH-11 | 75 + 75 | 78 |
| 43 (Inv.) | A-4 + CH-11 | 50 + 100 | 72 |

From Table 9, it is apparent that the combined use of dye-image stabilizers in accordance with the present invention gives advantageous effects.

Results listed in Table 9 indicate that, if a total amount of addition of the magenta dye image stabilizers is constant, the combined use of two types of magenta dye-image stabilizers of present invention at an appropriate ratio improves light fastness of a magenta dye-image much greatly than the use of only one magenta dye-image stabilizer of present invention.

The silver halide photographic light-sensitive material of the invention attains superior color reproducibility with fewer Y-stain occurrence.

EXAMPLE 10

The following layers were sequentially disposed, in the following order, on a paper support having lamination of polyethylene on both sides.

First layer: Emulsion layer

Magenta coupler 9 of the invention was applied at a rate of 4.5 mg/100 $cm^2$; a silver chloro-bromide emulsion (containing 85 mol % of silver bromide), at a rate of 3.5 mg/100 $cm^2$ as converted to the amount of silver; dibutyl phthalate, at a rate of 4.5 mg/100 $cm^2$; gelatin, at a rate of 12.0 mg/100 $cm^2$.

Second layer: Intermediate layer (layer containing ultraviolet absorbent)

2-(2-hydroxy-3-sec-butyl-5-t-butylphenyl)benzotriazole, serving as an ultraviolet absorbent, was applied at a rate of 5.0 mg/100 $cm^2$; dibutyl phthalate, at a rate of 5.0 mg/100 $cm^2$; gelatin, at a rate of 12.0 mg/100 $cm^2$.

Third layer: Protective layer

Gelatin was applied at a rate of 8.0 mg/100 $cm^2$.

The sample thus obtained was designated Sample 1.

Samples 2 through 11 were prepared in the same manner as Sample 1 except that in these samples dye-image stabilizer(s) as shown in Table 7 were added in an equal amount in terms of mol number to that of the magenta coupler.

In Samples 4 to 11, two magenta dye-image stabilizers were used in combination at an adding mol ratio of 1:1, making the total amount equivalent in terms of mol number to that of the magenta coupler.

Comparative compound a (Compound described in Japanese Patent O.P.I. Publication No. 48538/1979)

Comparative compound b (Compound described in Japanese Patent O.P.I. Publication No. 159644/1981)

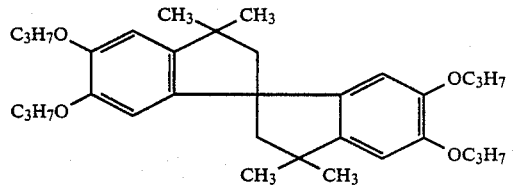

The prepared samples above were exposed to light through an optical wedge in compliance with a conventional method, and then treated in the following manner.

| [Treatment] | Temperature | Time |
|---|---|---|
| Color development | 33° C. | 3 min 30 sec |
| Bleaching-fixing | 33° C. | 1 min 30 sec |
| Washing | 33° C. | 3 min |
| Drying | 50–80° C. | 2 min |

The constituents of each processing solution are as follows:

| [Color developer] | |
|---|---|
| Benzyl alcohol | 12 ml |
| Diethylene glycol | 10 ml |
| Pottasium carbonate | 25 g |
| Sodium bromide | 0.6 g |
| Sodium sulfite anhydride | 2.0 g |
| Hydroxylamine sulfate | 2.5 g |
| N—ethylN—βmethanesulfonamidethyl-3-methyl-4-aminoaniline sulfate | 4.5 g |

One liter solution was prepared by adding water to the above components, and was adjusted to pH 10.2 with NaOH.

| [Bleach-fixing solution] | |
|---|---|
| Ammonium thiosulfate | 120 g |
| Sodium metabisulfite | 15 g |
| Sodium sulfite anhydride | 3 g |
| Ferric ammonium EDTA | 65 g |

One liter solution was prepared by adding water to the above components, and was adjusted to pH 6.7 to pH 6.8.

The densities of Samples 1 through 11 treated as above were measured with a photographic densitometer (Model KD-7R of Konica Corporation) under the following conditions.

Each sample treated as above was irradiated with a xenon fade-ometer for 12 days to check the dye image for light fastness.

The values representing light fastness and moisture resistance of a dye image are defined as follows.

[Residual ratio]

Residual dye percentage, obtained after the light fastness and moisture resistance tests, and relative to an initial density of 1.0.

[Discoloration ratio]

Value obtained by subtracting pre-light fastness test (yellow density)/(magenta density) value from post-light fastness test (yellow density)/(magenta density) value, relative to the initial density of 1.0. The greater this value is, the more readily a dye image turns from magenta to yellower.

Table 10 lists the results.

TABLE 10

| Sample No. | Coupler | Dye image stabilizer | Light fastness Residual Ratio (%) | Light fastness Discoloration ratio |
|---|---|---|---|---|
| 1 (Comp.) | 9 | — | 16 | 0.79 |
| 2 (Inv.) | 9 | A-3 | 59 | 0.21 |
| 3 (Inv.) | 9 | A-16 | 56 | 0.21 |
| 4 (Inv.) | 9 | A-3 + Comparative Compound a | 63 | 0.25 |
| 5 (Inv.) | 9 | A-16 + Comparative Compound a | 60 | 0.27 |
| 6 (Inv.) | 9 | A-3 + Comparative Compound b | 63 | 0.27 |
| 7 (Inv.) | 9 | A-16 + Comparative Compound b | 60 | 0.27 |
| 8 (Inv.) | 9 | A-3 + HI-7 | 72 | 0.14 |
| 9 (Inv.) | 9 | A-3 + HI-12 | 74 | 0.15 |
| 10 (Inv.) | 9 | A-16 + HI-7 | 68 | 0.16 |
| 11 (Inv.) | 9 | A-16 + HI-12 | 70 | 0.14 |

From Table 10, it is apparent that the combined use of dye-image stabilizers in accordance with the present invention gives advantageous effects.

EXAMPLE 11

Samples 12 through 34 were prepared by combining a coupler and magenta dye-image stabilizers as is presented in Table 11, whereby the layers were disposed in a manner identical with Example 10.

Samples 12 through 34 were prepared according to the same method presented in Example 10.

Furthermore, when the same light fastness test as Example 10 was performed with these samples, the following results presented in Table 11 were obtained.

TABLE 11

| Sample No. | Coupler | Dye image stabilizer | Light fastness Dye-image Residual Ratio (%) |
|---|---|---|---|
| 12 (Inv.) | 2 | A-4 | 45 |
| 13 (Inv.) | 2 | A-21 | 42 |
| 14 (Inv.) | 2 | A-4 + HI-11 | 69 |
| 15 (Inv.) | 2 | A-4 + HI-19 | 68 |
| 16 (Inv.) | 2 | A-21 + HI-11 | 65 |
| 17 (Inv.) | 2 | A-21 + HI-19 | 65 |
| 18 (Inv.) | 10 | A-4 | 50 |
| 19 (Inv.) | 10 | A-21 | 48 |
| 20 (Inv.) | 10 | A-4 + HI-11 | 71 |
| 21 (Inv.) | 10 | A-4 + HI-19 | 71 |
| 22 (Inv.) | 10 | A-21 + HI-11 | 67 |
| 23 (Inv.) | 10 | A-21 + HI-19 | 66 |
| 24 (Inv.) | 23 | A-4 | 53 |
| 25 (Inv.) | 23 | A-21 | 51 |
| 26 (Inv.) | 23 | A-4 + HI-11 | 76 |
| 27 (Inv.) | 23 | A-4 + HI-19 | 75 |
| 28 (Inv.) | 23 | A-21 + HI-11 | 71 |
| 29 (Inv.) | 23 | A-21 + HI-19 | 72 |
| 30 (Inv.) | 23 | A-9 + HI-3 | 72 |
| 31 (Inv.) | 23 | A-10 + HI-21 | 73 |
| 32 (Inv.) | 23 | A-20 + HI-3 | 72 |
| 33 (Inv.) | 23 | A-26 + HI-24 | 70 |
| 34 (Inv.) | 23 | A-28 + HI-26 | 71 |

From Table 11, it is apparent that the combined use of dye-image stabilizers in accordance with the present invention gives advantageous effects.

Table 11 shows that Samples obtained by adding two types of magenta dye-image stabilizers of the invention to a magenta coupler of the invention have remarkably improved light fastness than samples obtained by adding only one out of the two types of type of magenta dye stabilizers to a magenta coupler of the invention.

EXAMPLE 12

Sample 35, a silver halide multi-color photographic light-sensitive material, was prepared by applying the following coating materials sequentially onto a paper support having polyethylene lamination on both sides.

First layer: Blue-sensitive silver halide emulsion layer

α-pivaloyl-α-(2,4-dioxo-1-benzylimidazoline-3-yl)-2-chloro-5-[γ-(2,4-di-t-amylphenoxy)butylamide]acetanilide serving as a yellow coupler was applied at a rate of 6.8 mg/100 cm$^2$; a blue-sensitive silver chloro-bromide emulsion (containing 85 mol % of silver bromide), at a rate of 3.2 mg/100 cm$^2$ as converted to the amount of silver; dibutyl phthalate, at a rate of 3.5 mg/100 cm$^2$; gelatin, at a rate of 13.5 mg/100 cm$^2$.

Second layer: Intermediate layer 2,5-di-t-octylhydroquinone was applied at a rate of 0.5 mg/100 cm$^2$; dibutyl phthalate, at a rate of 0.5 mg/100 cm$^2$; gelatin, at a rate of 9.0 mg/100 cm$^2$.

Third layer: Green-sensitive silver halide emulsion layer

Magenta coupler 11 of the invention was applied at a rate of 4.2 mg/100 cm$^2$; a green-sensitive silver chloro-bromide emulsion (containing 80 mol % of silver bromide), at a rate of 2.5 mg/100 cm$^2$ as converted to the amount of silver; dibutyl phthalate, at a rate of 4.0 mg/100 cm$^2$; gelatin, at a rate of 12.0 mg/100 cm$^2$.

Fourth layer: Intermediate layer 2-(2-hydroxy-3-sec-butyl-5-t-butylphenyl)benzotriazole serving as an ultraviolet absorbent was applied at a rate of 3.0 mg/100 cm$^2$; dibutyl phthalate, at a rate of 3.0 mg/100 cm$^2$; 2,5-di-t-octylhydroquinone, at a rate of 0.5 mg/100 cm$^2$; gelatin, at a rate of 12.0 mg/100 cm$^2$.

Fifth layer: Red-sensitive silver halide emulsion layer

2-[α-(2,4-di-t-pentylphenoxy)butanamide]-4,6-dichloro-5-ethylphenol serving as a cyan coupler was applied at a rate of 4.2 mg/100 cm$^2$; a red-sensitive silver chloro-bromide emulsion (containing 80 mol % of silver bromide), at a rate of 3.0 mg/100 cm$^2$ as converted to the amount of silver; tricresyl phosphate, at a rate of 3.5 mg/100 cm$^2$; gelatin, at a rate of 11.5 mg/100 cm$^2$.

Sixth layer: Intermediate layer having constitution identical with that of fourth layer Seventh layer: Protective layer Gelatin was applied at a rate of 8.0 mg/100 cm$^2$.

Multi-layered Samples 35 through 43 were prepared by adding the magenta dye image stabilizers of the present invention to the third layer of the previously mentioned Sample 35 at respective rates shown in Table 12, and exposed to light and treated as in Example 10. Then the samples were irradiated with a xenon fadeometer for 14 days to test fastness to light.

Table 12 also lists the test results.

TABLE 12

| Sample No. | Dye-image stabilizer | Amount added Mol %/coupler | Magenta dye-image residual rate on light fastness (%) |
|---|---|---|---|
| 35 (Comp.) | — | — | 13 |
| 36 (Inv.) | A-4 | 100 | 52 |
| 37 (Inv.) | A-4 | 150 | 59 |
| 38 (Inv.) | A-4 + HI-12 | 75 + 25 | 69 |
| 39 (Inv.) | A-4 + HI-12 | 50 + 50 | 74 |
| 40 (Inv.) | A-4 + HI-12 | 25 + 75 | 65 |
| 41 (Inv.) | A-4 + HI-12 | 100 + 50 | 74 |
| 42 (Inv.) | A-4 + HI-12 | 75 + 75 | 79 |
| 43 (Inv.) | A-4 + HI-12 | 50 + 100 | 73 |

From Table 11, it is apparent that the combined use of dye-image stabilizers in accordance with the present invention gives advantageous effects.

Results listed in Table 12 indicate that, if a total amount of addition of the magenta dye image stabilizers is constant, the combined use of two types of magenta dye-image stabilizers of present invention at an appropriate ratio improves light fastness of a magenta dye-image much greatly than the use of only one magenta dye-image stabilizer of present invention.

The silver halide photographic light-sensitive material of the invention attains superior color reproducibility with fewer Y-stain occurrence.

EXAMPLE 13

The following coating materials were sequentially layered, in the following order, on a paper support having lamination of polyethylene on both sides.

First layer: Emulsion layer

Magenta coupler 9 of the invention was applied at a rate of 4.5 mg/100 $cm^2$; a silver chloro-bromide emulsion (containing 85 mol % of silver bromide), at a rate of 3.5 mg/100 $cm^2$ as converted to the amount of silver; dibutyl phthalate, at a rate of 4.5 mg/100 $cm^2$; gelatin, at a rate of 12.0 mg/100 $cm^2$.

Second layer: Intermediate layer (layer containing ultraviolet absorbent)

2-(2-hydroxy-3-sec-butyl-5-t-butylphenyl)benzotriazole, serving as an ultraviolet absorbent, was applied at a rate of 5.0 mg/100 $cm^2$; dibutyl phthalate, at a rate of 5.0 mg/100 $cm^2$; gelatin, at a rate of 12.0 mg/100 $cm^2$.

Third layer: Protective layer

Gelatin was applied at a rate of 8.0 mg/100 $cm^2$.

The sample thus obtained was designated Sample 1.

Samples 2 through 15 were prepared in the same manner as Sample 1 except that in these samples dye-image stabilizer(s) as shown in Table 13 were added in an equal amount in terms of mol number to that of the magenta coupler.

In Samples 3 to 15, two magenta dye-image stabilizers were used in combination at an adding mol ratio of 1:1 or 1:1:1, making the total amount in terms of mol number two times as much as to that of the magenta coupler.

Comparative compound a (Compound described in Japanese Patent O.P.I. Publication No. 48538/1979)

Comparative compound b (Compound described in Japanese Patent O.P.I. Publication No. 159644/1981)

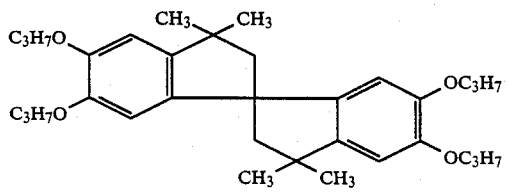

The prepared samples above were exposed to light through an optical wedge in compliance with a conventional method, and then treated in the following manner.

| [Treatment] | Temperature | Time |
|---|---|---|
| Color development | 33° C. | 3 min 30 sec |
| Bleach-fixing | 33° C. | 1 min 30 sec |
| Washing | 33° C. | 3 min |
| Drying | 50–80° C. | 2 min |

The constituents of each processing solution are as follows:

| [Color developer] | |
|---|---|
| Benzyl alcohol | 12 ml |
| Diethylene glycol | 10 ml |
| Potassium carbonate | 25 g |
| Sodium bromide | 0.6 g |
| Sodium sulfite anhydride | 2.0 g |
| Hydroxylamine sulfate | 2.5 g |
| N—ethyl-N—β-methanesulfonamidetyl-3-methyl-4-aminoaniline sulfate | 4.5 g |

One liter solution was prepared by adding water to the above components, and was adjusted to pH10.2 with NaOH.

| [Bleach-fixing solution] | |
|---|---|
| Ammonium thiosulfate | 120 g |
| Sodium metabisulfite | 15 g |
| Sodium sulfite anhydride | 3 g |
| Ferric ammonium EDTA | 65 g |

One liter solution was prepared by adding water to the above components, and was adjusted to pH6.7 to pH6.8.

The densities of Samples 1 through 15 treated as above were measured with a photographic densitometer (Model KD-7R of Konica Corporation) under the following conditions.

Each sample treated as above was irradiated with a xenon fade-ometer for 16 days to check the dye image for light fastness.

The values representing light fastness and moisture resistance of a dye image are defined as follows.

[Residual ratio]

Residual dye percentage, obtained after the light fastness and moisture resistance tests, and relative to an initial density of 1.0.

[Y-stain (Y-S)]

Value obtained by subtracting a Y-stain density before the light fastness and moisture resistance tests, from the Y-stain density after these tests.

[Discoloration ratio]

Value obtained by subtracting pre-light fastness test (yellow density)/(magenta density) value from post-light fastness test (yellow density)/(magenta density) value, relative to the initial density of 1.0. The greater this value is, the more readily a dye image turns from magenta to yellower.

TABLE 13

| Sample No. | Coupler | Dye image stabilizer | Light fastness: Residual Ratio (%) | Light fastness: Discoloration ratio |
|---|---|---|---|---|
| 1 (Comp.) | 11 | — | 10 | 0.75 |
| 2 (Inv.) | 11 | A-3 | 53 | 0.20 |
| 3 (Inv.) | 11 | A-3 + P-1 | 68 | 0.17 |
| 4 (Inv.) | 11 | A-3 + CH-11 | 69 | 0.16 |
| 5 (Inv.) | 11 | A-3 + HI-12 | 70 | 0.15 |

TABLE 13-continued

| Sample No. | Coupler | Dye image stabilizer | Light fastness Residual Ratio (%) | Light fastness Discoloration ratio |
|---|---|---|---|---|
| 6 (Inv.) | 11 | A-3 + Comparative Compound a | 57 | 0.24 |
| 7 (Inv.) | 11 | A-3 + Comparative Compound b | 59 | 0.26 |
| 8 (Inv.) | 11 | A-3 + P-1 + Comparative Compound a | 63 | 0.21 |
| 9 (Inv.) | 11 | A-3 + P-1 + Comparative Compound b | 64 | 0.21 |
| 10 (Inv.) | 11 | A-3 + CH-11 + Comparative Compound a | 64 | 0.19 |
| 11 (Inv.) | 11 | A-3 + CH-11 + Comparative Compound b | 63 | 0.20 |
| 12 (Inv.) | 11 | A-3 + HI-12 + Comparative Compound a | 65 | 0.20 |
| 13 (Inv.) | 11 | A-3 + HI-12 + Comparative Compound b | 63 | 0.22 |
| 14 (Inv.) | 11 | A-3 + P-1 + CH-11 | 78 | 0.09 |
| 15 (Inv.) | 11 | A-3 + P-1 + HI-12 | 79 | 0.10 |

Table 13 indicates, with Samples 14 and 15 obtained by simultaneously using three types of magenta dye-image stabilizers of the invention to a magenta coupler of the invention, that remarkable improvement in dye-image residual rate as a result of light fastness test is attained, and that dye-image discoloration due to the light fastness test is reduced in the same test.

EXAMPLE 14

Samples 16 through 38 were prepared by applying emulsions in a manner identical with that of Example 13, except that the respective combinations involving magenta couplers and magenta dye image stabilizers listed in Table 14 were used. These samples were subjected to the treatment described in Example 13.

Samples thus obtained were treated in the manner same to Example 13 and then tested for light fastness in the manner same to Example 13. The results are in Table 14.

The total amount of dye-image stabilizer/stabilizers was, whether singly or combinedly used, 1.5 times as many mols as coupler. When more than two stabilizers were used, they were used at a ratio of 1:1 by mol.

TABLE 14

| Sample No. | Coupler | Dye-image stabilizer | Light fastness Dye-image Residual Ratio (%) |
|---|---|---|---|
| 16 (Inv.) | 2 | A-4 | 48 |
| 17 (Inv.) | 2 | A-4 + P-6 | 65 |
| 18 (Inv.) | 2 | A-4 + CH-22 | 64 |
| 19 (Inv.) | 2 | A-4 + HI-11 | 66 |
| 20 (Inv.) | 2 | A-4 + P-6 + CH-22 | 71 |
| 21 (Inv.) | 2 | A-4 + P-6 + HI-11 | 72 |
| 22 (Inv.) | 2 | A-4 + P-6 + CH-22 + HI-11 | 75 |
| 23 (Inv.) | 10 | A-4 | 53 |
| 24 (Inv.) | 10 | A-4 + P-6 | 70 |
| 25 (Inv.) | 10 | A-4 + CH-22 | 71 |
| 26 (Inv.) | 10 | A-4 + HI-11 | 71 |
| 24 (Inv.) | 10 | A-4 + P-6 | 70 |
| 27 (Inv.) | 10 | A-4 + P-6 + CH-22 | 75 |
| 28 (Inv.) | 10 | A-4 + P-6 + HI-11 | 76 |
| 29 (Inv.) | 10 | A-4 + P-6 + CH-22 + HI-11 | 77 |
| 30 (Inv.) | 23 | A-4 | 54 |
| 31 (Inv ) | 23 | A-4 + P-6 | 72 |
| 32 (Inv.) | 23 | A-4 + CH-22 | 72 |
| 33 (Inv.) | 23 | A-4 + HI-11 | 73 |
| 34 (Inv.) | 23 | A-4 + P-6 + CH-22 | 80 |
| 35 (Inv.) | 23 | A-4 + P-6 + HI-11 | 82 |
| 36 (Inv.) | 23 | A-4 + P-6 + CH-22 + HI-11 | 84 |

TABLE 14-continued

| Sample No. | Coupler | Dye-image stabilizer | Light fastness Dye-image Residual Ratio (%) |
|---|---|---|---|
| 37 (Inv.) | 23 | A-4 + P-1 + CH-11 | 80 |
| 38 (Inv.) | 23 | A-4 + P-22 + HI-3 | 82 |

From Table 14, it is apparent that the combined use of three kinds of dye-image stabilizers in accordance with the present invention gives advantageous effects.

Table 14 shows that Samples obtained by applying the three or four magenta dye-image stabilizers selected from two groups of stabilizers to magenta coupler of this invention are remarkably improved in light fastness than samples obtained by applying one or two magenta dye-image stabilizers to magenta coupler of this invention.

EXAMPLE 15

Sample 39, a silver halide photographic light-sensitive material, was prepared by applying the following coating materials sequentially onto a paper support having polyethylene lamination on both sides.

First layer: Blue-sensitive silver halide emulsion layer

α-pivaloyl-α-(2,4-dioxo-1-benzylimidazoline-3-yl)-2-chloro-5-[γ-(2,4-di-t-amylphenoxy)butylamide]acetanilide serving as a yellow coupler was applied at a rate of 6.8 mg/100 cm$^2$; a blue-sensitive silver chloro-bromide emulsion (containing 85 mol % of silver bromide), at a rate of 3.2 mg/100 cm$^2$ as converted to the amount of silver; dibutyl phthalate, at a rate of 3.5 mg/100 cm$^2$; gelatin, at a rate of 13.5 mg/100 cm$^2$.

Second layer: Intermediate layer 2,5-di-t-octylhydroquinone was applied at a rate of 0.5 mg/100 cm$^2$; dibutyl phthalate, at a rate of 0.5 mg/100 cm$^2$; gelatin, at a rate of 9.0 mg/100 cm$^2$.

Third layer: Green-sensitive silver halide emulsion layer

The magenta coupler 11 of the invention was applied at a rate of 4.0 mg/100 cm$^2$; a green-sensitive silver chloro-bromide emulsion (containing 80 mol % of silver bromide), at a rate of 2.5 mg/100 cm$^2$ as converted to the amount of silver; dibutyl phthalate, at a rate of 4.0 mg/100 cm$^2$; gelatin, at a rate of 12.0 mg/100 cm$^2$.

Fourth layer: Intermedaite layer 2-(2-hydroxy-3-sec-butyl-5-t-butylphenyl)benzotriazole serving as an ultraviolet absorbent was applied at a rate of 4.0 mg/100 cm$^2$; dibutyl phthalate, at a rate of 4.0 mg/100 cm$^2$; 2,5-di-t-octylhydroquinone, at a rate of 0.5 mg/100 cm$^2$; gelatin, at a rate of 12.0 mg/100 cm$^2$.

Fifth layer: Red-sensitive silver halide emulsion layer

2-[α-(2,4-di-t-pentylphenoxy)butanamide]-4,6-dichloro-5-ethylphenol serving as a cyan coupler was applied at a rate of 4.2 mg/100 cm$^2$; a red-sensitive silver chloro-bromide emulsion (containing 80 mol % of silver bromide), at a rate of 3.0 mg/100 cm$^2$ as converted to the amount of silver; tricresyl phosphate, at a rate of 3.5 mg/100 cm$^2$; gelatin, at a rate of 11.5 mg/100 cm$^2$.

Sixth layer: Intermediate layer having constitution identical with that of fourth layer Seventh layer: Protective layer Gelatin aws applied at a rate of 8.0 mg/100 cm$^2$.

Multi-layered Samples 40 through 63 were prepared by adding the magenta dye image stabilizers of the present invention to the third layer of the previously mentioned Sample 39 at respective rates shown in Table 15, and exposed to light and treated as in Example 13. Then the samples were irradiated with a xenon fadeometer for 18 days to test fastness to light.

Table 15 also lists the test results.

From Table 15, it is apparent that the combined use of three or four kinds of dye-image stabilizers in accordance with the present invention gives advantageous effects.

TABLE 15

| Sample No. | Dye-image stabilizer | Amount added Mol %/coupler | Magenta dye-image residual rate on light fastness (%) |
|---|---|---|---|
| 39 (Comp.) | — | — | 6 |
| 40 (Inv.) | A-3 | 150 | 41 |
| 41 (Inv.) | A-3 + P-1 | 50 + 100 | 56 |
| 42 (Inv.) | A-3 + P-1 | 75 + 25 | 59 |
| 43 (Inv.) | A-3 + P-1 | 100 + 50 | 56 |
| 44 (Inv.) | A-3 + CH-11 | 50 + 100 | 54 |
| 45 (Inv.) | A-3 + CH-11 | 75 + 75 | 56 |
| 46 (Inv.) | A-3 + CH-11 | 100 + 50 | 55 |
| 47 (Inv.) | A-3 + HI-12 | 50 + 100 | 56 |
| 48 (Inv.) | A-3 + HI-12 | 75 + 75 | 59 |
| 49 (Inv.) | A-3 + HI-12 | 100 + 50 | 55 |
| 50 (Inv.) | A-3 + P-1 + CH-11 | 25 + 50 + 75 | 64 |
| 51 (Inv.) | A-3 + P-1 + CH-11 | 50 + 50 + 50 | 67 |
| 52 (Inv.) | A-3 + P-1 + CH-11 | 75 + 50 + 25 | 64 |
| 53 (Inv.) | A-3 + P-1 + CH-11 | 50 + 25 + 75 | 66 |
| 54 (Inv.) | A-3 + P-1 + CH-11 | 50 + 75 + 25 | 68 |
| 55 (Inv.) | A-3 + P-1 + CH-11 | 25 + 50 + 75 | 68 |
| 56 (Inv.) | A-3 + P-1 + CH-11 | 50 + 50 + 50 | 69 |
| 57 (Inv.) | A-3 + P-1 + CH-11 | 75 + 50 + 25 | 64 |
| 58 (Inv.) | A-3 + P-1 + CH-11 | 50 + 25 + 75 | 67 |
| 59 (Inv.) | A-3 + P-1 + CH-11 | 50 + 75 + 25 | 68 |
| 60 (Inv.) | A-3 + P-1 + CH-11 + HI-12 | 25 + 25 + 50 + 50 | 71 |
| 61 (Inv.) | A-3 + P-1 + CH-11 + HI-12 | 25 + 50 + 50 + 50 | 73 |
| 62 (Inv.) | A-3 + P-1 + CH-11 + HI-12 | 50 + 25 + 25 + 50 | 71 |
| 63 (Inv.) | A-3 + P-1 + CH-11 + HI-12 | 50 + 50 + 25 + 25 | 72 |

What is claimed is:

1. A silver halide photographic light-sensitive material which comprises a magenta dye-forming coupler represented by formula [M-I] and a compound represented by formula [A];

[M-I]

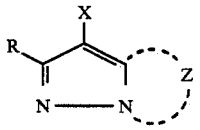

wherein Z represents a group of non-metal atoms necessary to complete a nitrogen-containing heterocycle which may have a substituent, X represents a hydrogen atom or a group capable of being split-off upon reaction with the oxidation product of a color developing agent and R represents a hydrogen atom or a substituent;

[A]

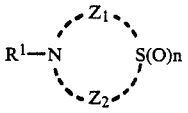

wherein $R^1$ represents an aryl group or heterocyclic group, $Z_1$ and $Z_2$ independently represent an alkylene group having 1 to 3 carbon atoms provided that the total number of carbon atoms within the alkylene groups represented by $Z_1$ and $Z_2$ is 3 to 6, and n is 1 or 2.

2. A silver halide photographic light-sensitive material which comprises a magenta dye-forming coupler represented by formula [M-I], a compound represented by formula [A], and a compound represented by [$B_1$];

[M-I]

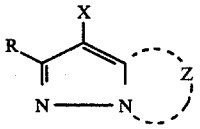

wherein Z represents a group of non-metal atoms necessary to complete a nitrogen-containing heterocycle which may have a substituent, X represents a hydrogen atom or a group capable of being split-off upon reaction with the oxidation product of a color developing agent and R represents a hydrogen atom or a substituent;

[A]

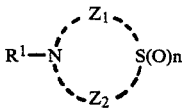

wherein $R^1$ represents an aryl group or heterocyclic group, $Z_1$ and $Z_2$ independently represent an alkylene group having 1 to 3 carbon atoms provided that the total number of carbon atoms within the alkylene groups represented by $Z_1$ and $Z_2$ is 3 to 6, and n is 1 or 2;

[$B_1$]

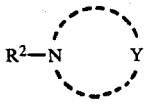

wherein $R^2$ represents an aliphatic group, a cycloalkyl group, an aryl group or a heterocyclic group and Y represents a group of non-metal atoms necessary to complete a piperazine ring or a homopiperazine ring together with the nitrogen atom in the formula provided that said piperazine or homopiperazine ring may have a substituent.

3. A silver halide photographic light-sensitive material which comprises a magenta dye-forming coupler represented by formula [M-I], a compound represented by formula [A], and a compound represented by [$B_2$];

[M-I]

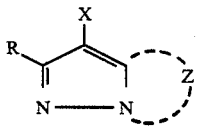

wherein Z represents a group of non-metal atoms necessary to complete a nitrogen-containing heterocycle which may have a substituent, X represents a hydrogen atom or a group capable of being split-off upon reaction with the oxidation product of a color developing agent and R represents a hydrogen atom or a substituent;

[A]

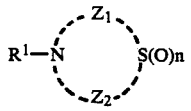

wherein $R^1$ represents an aryl group or heterocyclic group, $Z_1$ and $Z_2$ independently represent an alkylene group having 1 to 3 carbon atoms provided that the total number of carbon atoms within the alkylene groups represented by $Z_1$ and $Z_2$ is 3 to 6, and n is 1 or 2;

[$B_2$]

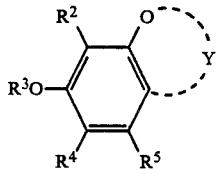

wherein $R^2$ and $R^5$ are independently selected from the group consisting of a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group and an alkoxycarbonyl group, $R^3$ is selected from the group consisting of a hydrogen atom, an alkyl group, an alkenyl group, an aryl group, an acyl group, a cycloalkyl group and a heterocyclic group, $R^4$ is selected from the group consisting of a hydrogen atom, a halogen atom, an alkyl group, an alkenyl group, an aryl group, an aryloxy group, an acyl group, an acylamino group, an acyloxy group, a sulfonamide group, acycloalkyl group or an alkoxycabonyl group provided that $R^3$ and $R^4$ may be linked together to form a five-member or six-member ring, or a methylenedioxy ring, and Y represents a group of non-metal atoms necessary to complete a chroman or coumarane ring which may have a substituent.

4. A silver halide photographic light-sensitive material which comprises a magenta dye-forming coupler represented by formula [M-I], a compound represented by formula [A], and a compound represented by [$B_3$];

[M-I]

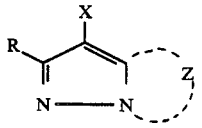

wherein Z represents a group of non-metal atoms necessary to complete a nitrogen-containing heterocycle which may have a substituent, X represents a hydrogen atom or a group capable of being split-off upon reaction with the oxidation product of a color developing agent and R represents a hydrogen atom or a substituent;

[A]

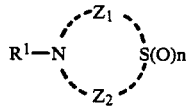

wherein $R^1$ represents an aryl group or heterocyclic group, $Z_1$ and $Z_2$ independently represent an alkylene group having 1 to 3 carbon atoms provided that the total number of carbon atoms within the alkylene groups represented by $Z_1$ and $Z_2$ is 3 to 6, and n is 1 or 2;

[$B_3$]

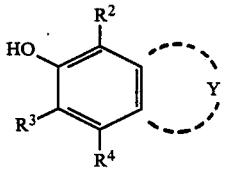

wherein $R^2$ and and $R^4$ are independently selected from the group consisting of a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group and an alkoxycarbonyl group, $R^3$ is selected from the group consisting of a hydrogen atom, an alkyl group, an alkenyl group, an aryl group, an acyl group, an acylamino group, an acyloxy group, a sulfonamide group, a cycloalkyl group and a heterocyclic group, provided that $R^3$ and $R^4$ may be linked together to form a five-member or six-member ring, and Y represents a group of non-metal atoms necessary to complete an indane ring which may have a substituent.

5. A silver halide photographic light-sensitive material which comprises a magenta dye-forming coupler represented by formula [M-I], a compound represented by formula [A], a compound represented by formula [$B_1$] and at least one compound represented by [$B_2$] or [$B_3$];

[M-I]

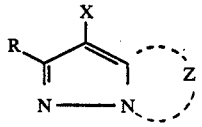

wherein Z represents a group of non-metal atoms necessary to complete a nitrogen-containing heterocycle which may have a substituent, X represents a hydrogen atom or a group capable of being split-off upon reaction with the oxidation product of a color developing agent and R represents a hydrogen atom or a substituent;

[A]

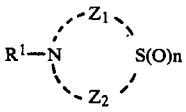

wherein $R^1$ represents an aryl group or heterocyclic group, $Z_1$ and $Z_2$ independently represent an alkylene group having 1 to 3 carbon atoms provided that the total number of carbon atoms, within the alkylene groups represented by $Z_1$ and $Z_2$ is 3 to 6, and n is 1 or 2;

[B1]

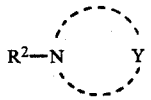

wherein $R^2$ represents an aliphatic group, a cycloalkyl group, an aryl group or a heterocyclic group and Y represents a group of non-metal atoms necessary to complete a piperazine ring or a homopiperazine ring together with the nitrogen atom in the formula provided that said piperazine or homopiperazine ring may have a substituent;

[B2]

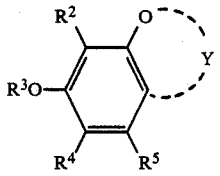

wherein $R^2$ and and $R^5$ are independently selected from the group consisting of a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfoiamide group, a cycloalkyl group and an alkoxycarbonyl group, $R^3$ is selected from the group consisting of a hydrogen atom, an alkyl group, an alkenyl group, an aryl group, an acyl group, a cycloalkyl group and a heterocyclic group, $R^4$ is selected from the group consisting of a hydrogen atom, a halogen atom, an alkyl group, an alkenyl group, an aryl group, an aryloxy group, an acyl group, an acylamino group, an acyloxy group, a sulfonamide group, acycloalkyl group or an alkoxycabonyl group provided that $R^3$ and $R^4$ may be linked together to form a five-member or six-member ring, or a methylenedioxy ring, and Y represents a group of non-metal atoms necessary to complete a chroman or coumarane ring which may have a substituent;

[B3]

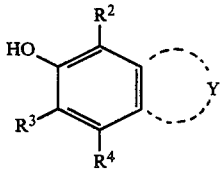

wherein $R^2$ and and $R^4$ are independently selected from the group consisting of a hydrogen atom, a halogen atom, an alkyl group, an alkenyl group, an alkoxy group, an alkenyloxy group, a hydroxy group, an aryl group, an aryloxy group, an acyl group, an acylamino group, an acyloxy group, a sulfonamide group, a cycloalkyl group and an alkoxycarbonyl group, $R^3$ is selected from the group consisting of a hydrogen atom, an alkyl group, an alkenyl group, an aryl group, an acyl group, an acylamino group, an acyloxy group, a sulfonamide group, a cycloalkyl group and a heterocyclic group, provided that $R^3$ and $R^4$ may be linked together to form a five-member or six-member ring, and Y represents a group of non-metal atoms necessary to complete an indane ring which may have a substituent.

* * * * *